US006361932B1

(12) United States Patent
Parton et al.

(10) Patent No.: US 6,361,932 B1
(45) **Date of Patent: *Mar. 26, 2002**

(54) PHOTOGRAPHIC MATERIAL HAVING ENHANCED LIGHT ABSORPTION

(75) Inventors: Richard L. Parton, Webster; Thomas L. Penner, Fairport; William J. Harrison; Margaret J. Helber, both of Rochester, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/151,916

(22) Filed: Sep. 11, 1998

(51) Int. Cl.[7] ..... G03C 1/12; G03C 1/005

(52) U.S. Cl. ..... 430/572; 430/574; 430/577; 430/580; 430/581; 430/583; 430/584; 430/585

(58) Field of Search ..... 430/572, 574, 430/583, 584, 585, 577, 580, 581

(56) References Cited

U.S. PATENT DOCUMENTS

| | | | | |
|---|---|---|---|---|
| 2,430,558 | A | | 11/1947 | Carroll et al. |
| 2,518,731 | A | | 8/1950 | Thompson |
| 3,622,316 | A | | 11/1971 | Bird et al. |
| 3,822,136 | A | | 7/1974 | Sakazume et al. |
| 3,976,493 | A | | 8/1976 | Borror et al. |
| 3,976,640 | A | | 8/1976 | Borror et al. |
| 4,040,825 | A | | 8/1977 | Steiger et al. |
| 4,138,551 | A | | 2/1979 | Steiger et al. |
| 4,820,606 | A | | 4/1989 | Miyasaka et al. |
| 4,950,587 | A | | 8/1990 | Roberts et al. |
| 5,707,794 | A | | 1/1998 | Fabricius |
| 6,117,629 | A | * | 9/2000 | Yamashita ..... 430/570 |

FOREIGN PATENT DOCUMENTS

| | | | |
|---|---|---|---|
| EP | 270082 | | 7/1992 |
| EP | 0545453 | A1 | 11/1992 |
| EP | 565074 | | 10/1993 |
| EP | 270079 | | 3/1994 |
| EP | 838719 | | 4/1998 |
| JP | 64-91134 | | 4/1989 |
| JP | 10 171058 | A | 6/1998 |
| JP | 10171058 | * | 6/1998 |

OTHER PUBLICATIONS

Hackh's Chemical Dictionary, Fourth Edition, Julius Grant, 1969*

P.B. Gilman, Jr.: "Review of the Mechanisms of Supersensitization". Photographic Science and Engineering. vol. 18, No. 4, Aug. 1974 (1974–08) pp. 418–430 XP002126385: Database WPI, Section Ch, Week 199836, Derwent Pub. Ltd., London, GB; Class E23, AN 1998–418050.

T. Forster, *Disc. Faraday Soc.*, vol. 27, 1959, p. 7.

R. Steiger and J. F. Reber, *Photogr. Sci. and Eng.*, vol. 27, 1983, p. 59.

T. L. Penner and P. B. Gilman, *Photogr. Sci. and Eng.*, vol. 20, 1976, p. 97.

T. L. Penner, *Photogr. Sci. and Eng.*, vol. 21, 1977, p. 32.

* cited by examiner

*Primary Examiner*—Thorl Chea
(74) *Attorney, Agent, or Firm*—Edith A. Rice

(57) ABSTRACT

This invention comprises a silver halide photographic material comprising at least one silver halide emulsion comprising silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2, wherein Dye 2 is other than a cyanine dye, wherein the dye layers are held together by non-covalent forces; the outer dye layer adsorbs light at equal or higher energy than the inner dye layer; and the energy emission wavelength of the outer dye layer overlaps with the energy absorption wavelength of the inner dye layer.

This invention also comprises a silver halide photographic material comprising at least one silver halide emulsion comprising silver halide grains having associated therewith at least one dye having at least one anionic substituent and at least one dye having at least one cationic substituent, with the proviso that one of the dyes is other than a cyanine dye.

18 Claims, No Drawings

PHOTOGRAPHIC MATERIAL HAVING ENHANCED LIGHT ABSORPTION

FIELD OF THE INVENTION

This invention relates to a silver halide photographic material containing at least one silver halide emulsion which has enhanced light absorption.

BACKGROUND OF THE INVENTION

J-aggregating cyanine dyes are used in many photographic systems. It is believed that these dyes adsorb to a silver halide emulsion and pack together on their "edge" which allows the maximum number of dye molecules to be placed on the surface. However, a monolayer of dye, even one with as high an extinction coefficient as a J-aggregated cyanine dye, absorbs only a small fraction of the light impinging on it per unit area. The advent of tabular emulsions allowed more dye to be put on the grains due to increased surface area. However, in most photographic systems, it is still the case that not all the available light is being collected.

The need is especially great in the blue spectral region where a combination of low source intensity and relatively low dye extinction result in deficient photoresponse. The need for increased light absorption is also great in the green sensitization of the magenta layer of color negative photographic elements. The eye is most sensitive to the magenta image dye and this layer has the largest, impact on color reproduction. Higher speed in this layer can be used to obtain improved color and image quality characteristics. The cyan layer could also benefit from increased red-light absorption which could allow the use of smaller enulsions with less radiation sensitivity and improved color and image quality characteristics. For certain applications, it may be useful to enhance infrared light absorption in infrared sensitized photographic elements to achieve greater sensitivity and image quality characteristics.

One way to achieve greater light absorption is to increase the amount of spectral sensitizing dye associated with the individual grains beyond monolayer coverage of dye (some proposed approaches are described in the literature, G. R. Bird, *Photogr. Sci. Eng.,* 18, 562 (1974)). One method is to synthesize molecules in which two dye chromophores are covalently connected by a linking group (see U.S. Pat. Nos. 2,518,731, 3,976,493, 3,976,640, 3,622,316, Kokai Sho 64(1989)91134, and EP 565,074). This approach suffers from the fact that when the two dyes are connected they can interfere with each other's performance, e.g., not aggregating on or adsorbing to the silver halide grain properly.

In a similar approach, several dye polymers were synthesized in which cyanine dyes were tethered to poly-L-lysine (U.S. Pat. No. 4,950,587). These polymers could be combined with a silver halide emulsion, however, they tended to sensitize poorly and dye stain (an unwanted increase in D-min due to retained sensitizing dye after processing) was severe in this system and unacceptable.

A different strategy involves the use of two dyes that are not connected to one another. In this approach the dyes can be added sequentially and are less likely to interfere with one another. Miysaka et al. in EP 270 079 and EP 270 082 describe silver halide photographic material having an emulsion spectrally sensitized with an adsorable sensitizing dye used in combination with a non-adsorable luminescent dye which is located in the gelatin phase of the element. Steiger et al. in U.S. Pat. Nos. 4,040,825 and 4,138,551 describe silver halide photographic material having an emulsion spectrally sensitized with an adsorable sensitizing dye used in combination with second dye which is bonded to gelatin. The problem with these approaches is that unless the dye not adsorbed to the grain is in close proximity to the dye adsorbed on the grain (less than 50 angstroms separation) efficient energy transfer will not occur (see T. Förster, *Disc. Faraday Soc.,* 27, 7 (1959)). Most dye off-the-grain in these systems will not be close enough to the silver halide grain for energy transfer, but will instead absorb light and act as it filter dye leading to a speed loss. A good analysis of the problem with this approach is given by Steiger et al. (*Photogr. Sci. Eng.,* 27, 59 (1983)).

A more useful method is to have two or more dyes form layers on the silver halide grain. Penner and Gilman described the occurrence of greater than monolayer levels of cyanine dye on emulsion grains, *Photogr. Sci. Eng.,* 20, 97 (1976); see also Penner, *Photogr. Sci. Eng.,* 21, 32 (1977). In these cases, the outer dye layer absorbed light at a longer wavelength than the inner dye layer (the layer adsorbed to the silver halide grain). Bird et al. in U.S. Pat. No. 3,622,316 describe a similar system. A requirement was that the outer dye layer absorb light at a shorter wavelength than the inner layer. This appears to be the closest prior art to our invention. The problem with previous dye layering approaches was that the dye layers described produced a very broad sensitization envelope. This would lead to poor color reproduction since, for example, the silver halide grains in the same color record would be sensitive to both green and red light.

Yamashita et. al. (EP 838 719 A2) describes the use of two or more cyanine dyes to form more than one dye layer on silver halide emulsions. The dyes are required to have at least one aromatic or heteroaromatic substituent attached to the chromophore via the nitrogen atoms of the dye. Yamashita et. al. teaches that dye layering will not occur if this requirement is not met. This is undesirable because such substitutents can lead to large amounts of retained dye after processing (dye stain) which affords increased D-min. We have found that this is not necessary and that neither dye is required to have a at least one aromatic or heteroaromatic substitute attached to the chromophore via the nitrogen atoms of the dye.

PROBLEM TO BE SOLVED BY THE INVENTION

Not all the available light is being collected in many photographic systems. The need is especially great in the blue spectral region where a combination of low source intensity and relatively low dye extinction result in deficient photoresponse. The need for increased light absorption is also great in the green sensitization of the magenta layer of color negative photographic elements. The eye is most sensitive to the magenta image dye and this layer has the largest impact on color reproduction. Higher speed in this layer can be used to obtain improved color and image quality characteristics. The cyan layer could also benefit from increased red-light absorption which could allow the use of smaller emulsions with less radiation sensitivity and improved color and image quality characteristics. For certain applications, it may be useful to enhance infrared light absorption in infrared sensitized photographic elements to achieve greater sensitivity and image quality characteristics.

SUMMARY OF THE INVENTION

We have found that it is possible to form more than one dye layer on silver halide emulsion grains and that this can afford increased light absorption. The dye layers are held together by a non-covalent attractive force such as electrostatic bonding, van der Waals interactions, hydrogen bonding, hydrophobic interactions, dipole-dipole interactions, dipole-induced dipole interactions, London dispersion forces, cation—π interactions, etc. or by in situ bond formation. The inner dye layer(s) is absorbed to the silver halide grains and contains at least one spectral sensitizer. The outer dye layer(s) (also referred to herein as an antenna dye layer(s)) absorbs light at an equal or higher energy (equal or shorter wavelength) than the adjacent inner dye layer(s). The light energy emission wavelength of the outer dye layer overlaps with the light energy absorption wavelength of the adjacent inner dye layer.

We have also found that silver halide grains sensitized with at least one dye containing at least one anionic substituent and at least one dye containing at least one, cationic substituent provides increased light absorption.

One aspect of this invention comprises a silver halide photographic material comprising at least one silver halide emulsion comprising silver halide grains having associated therewith at least two dye layers comprising (a) an inner dye layer adjacent to the silver halide grain and comprising at least one Ae, Dye 1, that is capable of spectrally sensitizing silver halide and (b) an outer dye layer adjacent to the inner dye layer and comprising at least one dye, Dye 2, wherein Dye 2 is other than a cyanine dye. In preferred embodiments of the invenion Dye 2 is a merocyanine dye, oxonol, dye, arylidene dye, complex merocyanine dye, styryl dye, hemioxonol dye, anthraquinone dye, triphenylmethane dye, azo dye type, azomethine dye, or coumarin dye, wherein the dye layers are held together by non-covalent forces; the outer dye layer adsorbs light at equal or higher energy than the inner dye layer; and the energy emission wavelength of the outer dye layer overlaps with the energy absorption wavelength of the inner dye layer.

Another aspect of this invention comprises a silver halide photographic material comprising at least one silver halide emulsion comprising silver halide grains having associated therewith at least one dye having at least one anionic substituent and at least one dye having at least one cationic substituent, with the proviso that one of the dyes is other than a cyanine dye, preferably a merocyanine dye, oxonol, dye, arylidene dye, complex merocyanine dye, styryl dye, hemioxonol dye, anthraquinone dye, triphenylmethane dye, azo dye type, azomethine dye, or coumarin dye.

ADVANTAGEOUS EFFECT OF THE INVENTION

The invention provides increased light absorption and photographic sensitivity by forming more than one layer of sensitizing dye on silver halide grains. The increased sensitivity could be used to improve granularity by using smaller emulsions and compensating the loss in speed due to the smaller emulsions by the increased light absorption of the dye layers of the invention. In addition to improved granularity, the smaller emulsions would have lower ionizing radiation sensitivity. Radiation sensitivity is determined by the mass of silver halide per grain. The invention also provides good color reproduction, i.e., no excessive unwanted absorptions in a different color record. Further, the amount of retained dye after processing is minimized by using dyes that do not contain hydrophobic nitrogen substituents and preferably the dyes of the second layer are bleachable dyes. This invention achieves these features whereas methods described in the prior art can not.

DETAILED DESCRIPTION OF THE INVENTION

As mentioned above, in preferred embodiments of the invention silver halide grains have associated therewith dyes layers that are held together by non-covalent attractive forces. Examples of non-covalent attractive forces include electrostatic attraction, hydrogen-bonding, hydrophobic, and van der Waals interactions or any combinations of these. In addition, in situ bond formation between complimentary chemical groups would be valuable for this invention. For example, one layer of dye containing at least one boronic acid substituent could be formed. Addition of second dye having at least one diol substituent could result in the formation of two dye layers by the in situ formation of boron-diol bonds between the dyes of the two layers. Another example of in situ bond formation would be the formation of a metal complex between dyes that are adsorbed to silver halide and dyes that can form a second or subsequent layer. For example, zirconium could be useful for binding dyes with phosphonate substitutents into dye layers, For a non-silver halide example see H. E. Katz et. al., Science, 254, 1485, (1991).

In a preferred embodiment the current invention uses a combination of a cyanine dye with at least one anionic substituent and a second dye with at least one cationic substituent wherein the second dye is not a cyanine dye. In another preferred embodiment the second dye with at least one cationic substituent is a merocyanine or oxonol dye. It is preferred that the second dye at least partially decolorize during processing to decrease dye stain.

To determine the increased light absorption by the photographic element as a result of forming an outer dye layer in addition to the inner dye layer, it is necessary to compare the overall absorption of the emulsion subsequent to the addition df the dye or dyes of the inner dye layer with the overall absorption of the emulsion subsequent to the further addition of the dye or dyes of the outer dye layer. This measurement of absorption can be done in a variety of ways known in the art, but a particularly convenient and directly applicable method is to measure the absorption spectrum as a function of wavelength of a coating prepared on a planar support from the liquid emulsion in the same manner as is conventionally done for photographic exposure evaluation. The methods of measurement of the total absorption spectrum, in which the absorbed fraction of light incident in a defined manner on a sample as a function of the wavelength of the impinging light for a turbid material such as a photographic emulsion coated onto a planar support, have been described in detail (for example see F. Grum and R. J. Becherer, "Optical Radiation Measurements, Vol. 1, Radiometry", Academic Press, New York, 1979). The absorbed fraction of incident light can be designated by $A(\lambda)$, where A is the fraction of incident light absorbed and $\lambda$ is the corresponding wavelength of light. Although $A(\lambda)$ is itself a useful parameter allowing graphical demonstration of the increase in light absorption resulting from the formation of additional dye layers described in this invention, it is desirable to replace such a graphical comparison with a numerical one. Further, the effectiveness with which the light absorption capability of an emulsion coated on a planar support is converted to photographic image depends, in addition to $A(\lambda)$, on the wavelength distribution of the irradiance $I(\lambda)$ of the exposing light source. (Irradiance at different wavelengths of light sources can be obtained by well-known measurement techniques. See, for example, F. Grum and R. J. Becherer, "Optical Radiation Measurements, Vol. 1, Radiometry", Academic Press, New York, 1979.) A further refinement follows from the fact that photographic image formation is, like other photochemical processes, a quantum effect so that the irradiance which is usually measured in units of energy per unit time per unit area, needs to be converted into quanta of light $N(\lambda)$ via the formula $N(\lambda)=I(\lambda)\lambda/hc$ where h is Planck's constant and c is the speed of light. Then the number of absorbed photons per unit time per unit area at a given wavelength for a photographic coating is given by: $N_a(\lambda)=A(\lambda)N(\lambda)$. In most instances, including the experiments described in the Examples of this invention, photographic exposures are not performed at a single or narrow range of wavelengths but rather simultaneously over a broad spectrum of wavelengths designed to simulate a particular illuminant found in real photographic situations, for example daylight. Therefore the total number of photons of light absorbed per unit time per unit area from such an illuminant consists of a summation or integration of all the values of the individual wavelengths, that is: $N_a=\int A(\lambda)N(\lambda)d\lambda$, where the limits of integration correspond to the wavelength limits of the specified illuminant. In the Examples of this invention, comparison is made on a relative basis between the values of the total number of photons of light absorbed per unit time per unit area of the coating of emulsion containing the sensitizing inner dye layer alone set to a value of 100 and the total number of photons of light absorbed per unit time of the coatings containing an outer dye layer in addition to inner dye layer. These relative values of $N_a$ are designated as Normalized Relative Absorption and are tabulated in the Examples. Enhancement of the Normalized Relative Absorption is a quantitative measure of the advantageous light absorption effect of this invention.

As stated in the Background of the Invention, some previous attempts to increase light absorption of emulsions resulted in the presence of dye that was too remote from the emulsion grains to effect energy transfer to the dye adsorbed to the grains, so that a significant increase in photographic sensitivity was not realized. Thus an enhancement in Relative Absorption by an emulsion is alone not a sufficient measurement of the effectiveness of additional dye layers. For this purpose a metric must be defined that relates the enhanced absorption to the resulting increase in photographic sensitivity. Such a parameter is now described.

Photographic sensitivity can be measured in various ways. One method commonly practiced in the art and described in numerous references (for example in *The Theory of the Photographic Process,* $4^{th}$ edition, T. H. James, editor, Macmillan Publishing Co., New York, 1977) is to expose an emulsion coated onto a planar substrate for a specified length of time through a filtering element, or tablet interposed between the coated emulsion and light source which modulates the light intensity in a series of uniform steps of constant factors by means of the constructed increasing opacity of the filter elements of the tablet. As a result the exposure of the emulsion coating is spatially reduced by this factor in discontinuous steps in one direction, remaining constant in the orthogonal direction. After exposure for a time required to cause the formation of developable image through a portion but not all the exposure steps, the emulsion coating is processed in an appropriate developer, either black and white or color, and the densities of the image steps are measured with a densitometer. A graph of exposure on a relative or absolute scale, usually in logarithmic form, defined as the irradiance multiplied by the exposure time, plotted against the measured image density can then be constructed. Depending on the purpose, a suitable image density is chosen as reference (for example 0.15 density above that formed in a step which received too low an exposure to form detectable exposure-related image). The exposure required to achieve that reference density can then be determined from the constructed graph, or its electronic counterpart. The inverse of the exposure to reach the reference density is designated as the emulsion coating sensitivity S. The value of $Log_{10}S$ is termed the speed. The exposure can be either monochromatic over a small wavelength range or consist of many wavelengths over a broad spectrum as already described. The film sensitivity of emulsion coatings containing only the inner dye layer or, alternatively, the inner dye layer plus an outer dye layer can be measured as described using a specified light source, for example a simulation of daylight. The photographic sensitivity of a particular example of an emulsion coating containing the inner dye layer plus an outer dye layer can be compared on a relative basis with a corresponding reference of an emulsion coating containing only the inner dye layer by setting S for the latter equal to 100 and multiplying this times the ratio of S for the invention example coating containing an inner dye layer plus outer dye layer to S for the comparison example containing only the inner dye layer. These values are designated as Normalized Relative Sensitivity. They are tabulated in the Examples along with the corresponding speed values. Enhancement of the Normalized Relative Sensitivity is a quantitative measure of the advantageous photographic sensitivity effect of this invention.

As a result of these measurements of emulsion coating absorption and photographic sensitivity, one obtains two sets of parameters for each example, $N_a$ and S, each relative to 100 for the comparison example containing only the inner dye layer. The exposure source used to calculate $N_a$ should be the same as that used to obtain S. The increase in these parameters $N_a$ and S over the value of 100 then represent respectively the increase in absorbed photons and in photographic sensitivity resulting from the addition of an outer dye layer of this invention. These increases are labeled respectively $\Delta N_a$ and $\Delta S$. It is the ratio of $\Delta S/\Delta N_a$ that measures the effectiveness of the outer dye layer to increase photographic sensitivity. This ratio, multiplied by 100 to convert to a percentage, is designated the Layering Efficiency, designated E, and is tabulated in the Examples, set forth below along with S and $N_a$. The Layering Efficiency measures the effectiveness of the increased absorption of this invention to increase photographic sensitivity. When either $\Delta S$ or $\Delta N_a$ is zero, then the Layering Efficiency is effectively zero.

In preferred embodiments, the following relationship is met:

$$E=100\Delta S/\Delta N_a \geqq 10$$

and $$\Delta N_a \geqq 10$$

wherein

E is the layering efficiency;

$\Delta S$ is the difference between the Normalized Relative Sensitivity (S) of an emulsion sensitized with the inner dye layer and the Normalized Relative Absorption of an emulsion sensitized with both the inner dye layer and the outer dye layer; and $\Delta N_a$ is the difference between the Normalized Relative Absorption ($N_a$) of an emulsion sensitized with the inner dye layer and the Normalized Relative Absorption of an emulsion sensitized with both the inner dye layer and the outer dye layer.

In order to realize the maximal light capture per unit area of silver halide, it is preferred that the dye or dyes of the outer dye layer (also referred to herein as antenna dye(s), plus any additional dye layers in a multilayer deposition, also be present in a J-aggregated state. For the preferred dyes, the J-aggregated state affords both the highest extinction coefficient and fluorescence yield per unit concentration of dye. Furthermore, extensively J-aggregated secondary cationic dye layers are practically more robust, particularly with respect to desorption and delayering by anionic surfactant-stabilized color coupler dispersions. In addition, when the referred dyes are layered above a conventional cyanine sensitizing dye of opposite charge which is adsorbed directly to the silver halide surface, the inherent structural dissimilarity of the two dye classes minimizes co-adsorption and dye mixing (e.g., cyanine dye plus merocyanine dye) on the grain. Uncontroled surface co-aggregation between dyes of opposite charge (e.g. anionic cyanine plus cationic cyanine) can result in a variety of undesirable photographic effects, such as severe desensitization.

In one preferred embodiment, the antenna dye layer can form a well-ordered liquid-crystalline phase (a lyotropic mesophase) in aqueous media (e.g. water, aqueous gelatin, methanolic aqueous gelatin etc.), and preferably forms a smectic liquid-crystalline phase (W. J.Harrison, D. L. Mateer & G. J. T. Tiddy, *J.Phys.Chem.* 1996, 100, pp 2310–2321). More specifically, in one embodiment preferred antenna dyes will form liquid-crystalline J-aggregates in aqueous-eased media (in the absence of silver halide grains) at any equivalent molar concentration equal to, or 4 orders of magnitude greater than, but more preferably at any equivalent molar concentration equal to or less than, the optimum level of primary silver halide-adsorbed dye deployed for conventional sensitization (see *The Theory of the Photographic Process,* $4^{th}$ edition, T. H. James, editor, Macmillan Publishing Co., New York, 1977, for a discussion of aggregation).

Mesophase-forming dyes may be readily identified by someone skilled in the art using polarized-light optical microscopy as described by N. H. Hartshorne in *The Microscopy of Liquid Crystals,* Microscope Publications Ltd., London, 1974. In one embodiment, preferred antenna dyes when dispersed in the aqueous medium of choice (including water, aqueous gelatin, aqueous methanol etc. with or without dissolved electrolytes, buffers, surfactants and other common sensitization addenda) at optimum concentration and temperature and viewed in polarized light as thin films sandwiched between a glass microscope slide and cover slip display the birefringence textures, patterns and flow rheology characteristic of distinct and readily identifiable structural types of mesophase (e.g. smectic, nematic, hexagonal). Furthermore, in one embodiment, the preferred dyes when dispersed in the aqueous medium as a liquid-crystalline phase generally exhibit J-aggregation resulting in a unique bathochromically shifted spectral absorption band yielding high fluorescence intensity. In another embodiment useful hypsochromically shifted spectral absorption bands may also result from the stabilization of a liquid-crystalline phase of certain other preferred dyes. In certain other embodiments of dye layering, especially in the case of dye layering via in situ bond formation, it may be desirable to use antenna dyes that do not aggregate.

In another preferred embodiment the second layer comprises a mixture of merocyanine dyes. Wherein at least one merocyanine has a cationic substituent and at least one merocyanine dye has an anionic substituent. Merocyanine dyes with anionic substituents are well know in the literature (see Hamer, (*Cyanine Dyes and Related Compounds,* 1964 (publisher John Wiley & Sons, New York, N.Y.)). Merocyanine dyes with cationic substituents have been described in U.S. Pat. No. 4,028,353.

In a preferred embodiment, the first dye layer comprises one or more cyanine dyes. Preferably the cyanine dyes have at least one negatively charged substituent. In another preferred embodiment, the second dye layer comprises one or more merocyanine dyes. Preferably the merocyanine dyes have at least one positively charged substituent. More preferably the second dye layer consists of a mixture of merocyanine dyes that have at least one positively charged substituent and merocyanine dyes that have at least one negatively charged substituent.

The dye or dyes of the first layer are added at a level such that, along with any other adsorbants (e.g., antifogants), they will substantially cover at least 80% and more preferably 90% of the surface of the silver halide grain. The area a dye covers on the silver halide surface can be determined preparing a dye concentration series and choosing the dye level for optimum performance or by well-known techniques such as dye adsorption isotherms (for example see W. West, B. H. Carroll, and D. H. Whitcomb, J. Phys. Chem, 56, 1054 (1962)).

For green light absorbing dyes a preferred embodiment is that at least one dye of the first layer contain a benzoxazole nucleus. The benzoxazole nucleus is independently substituted with an aromatic substituent, such as a phenyl group, a pyrrole group, etc.

In some cases, during dye addition and sensitization of the silver halide emulsion, it appears that excess gelatin can interfere with the dye layer formation. In some cases, it is preferred to keep the gelatin levels below 8% and preferably below 4% by weight. Additional gelatin can be added after the dye layers have formed.

In one preferred embodiment, a molecule containing a group that strongly bonds to silver halide, such as a mercapto group (or a molecule that forms a mercapto group under alkaline or acidic conditions) or a thiocarbonyl group is added after the first dye layer has been formed and before the second dye layer is formed. Mercapto compounds represented by the following formula (A) are particularly preferred.

A

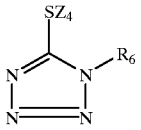

wherein $R_6$ represents an alkyl group, an alkenyl group or an aryl group and $Z_4$ represents a hydrogen atom, an alkali metal atom, an ammonium group or a protecting group that can be removed under alkaline or acidic conditions. Examples of some preferred mercapto compounds are shown below.

A-1

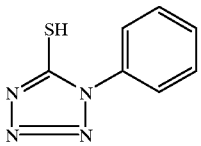

A-2

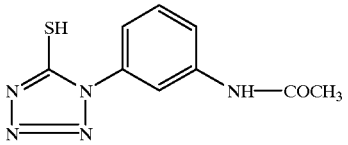

A-3

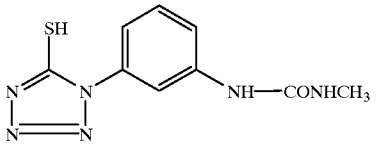

A-4

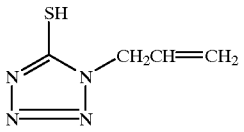

-continued

A-5

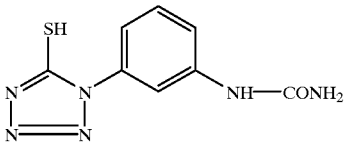

In describing preferred embodiments of the invention, one dye layer is described as an inner layer and one dye layer is described as an outer layer. It is to be understood that one or more intermediate dye layers may be present between the inner and outer dye layers, in which all of the layers are held together by non-covalent forces, as discussed in more detail above. Further, the dye layers need not completely encompass the silver halide grains of underlying dye layer(s). Also some mixing of the dyes between layers is possible.

The dyes of the first dye layer are any dyes capable of spectrally sensitizing a silver halide emulsion, for example, a cyanine dye, merocyanine dye, complex cyanine dye, complex merocyanine dye, homopolar cyanine dye, or hemicyanine dye, etc. Of these dyes, merocyanine dyes containing a thiocarbonyl group and cyanine dyes are particularly useful. Of these, cyanine dyes are especially useful. Particularly preferred as dyes for the first layer are cyanine dyes of Formula Ia or merocyanine dyes of Formula Ib.

(Ia)

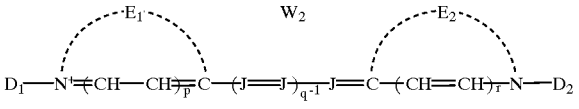

wherein:

$E_1$ and $E_2$ may be the same or different and represent the atoms necessary to form a substituted or unsubstituted heterocyclic ring which is a basic nucleus (see *The Theory of the Photographic Process,* $4^{th}$ edition, T. H. James, editor, Macmillan Publishing Co., New York, 1977 for a definition of basic and acidic nucleus), each J independently represents a substituted or unsubstituted methine group, q is a positive integer of from 1 to 4, p and r each independently represents 0 or 1, $D_1$ and $D_2$ each independently represents substituted or unsubstituted alkyl or unsubstituted aryl and at least one of $D_1$ and $D_2$ contains an anionic substituent, $W_2$ is one or more a counterions as necessary to balance the charge;

(Ib)

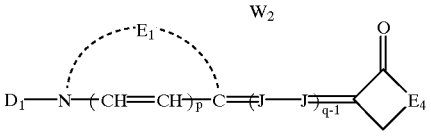

wherein $E_1$, $D_1$, J, p, q and $W_2$ are as defined above for formula (Ia) wherein $E_4$ represents the atoms necessary to complete a substituted or unsubstituted heterocycic acidic nucleus which preferably contains a thiocarbonyl;

In another preferred embodiment the inner dye layer contains at least one dye of Formula Ic:

Ic

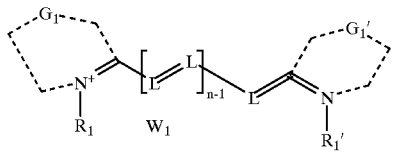

wherein:

$G_1$, $G_1'$ and $E_1$ independently represent the non-metallic atoms required to complete a substituted or unsubstituted ring system containing at least one 5- or 6-membered heterocyclic nucleus; n is a positive integer from 1 to 4, each L independently represents a substituted or unsubstituted methine group, $R_1$ and $R_1'$ each independently represents a substituted or unsubstituted aryl or substituted or unsubstituted aliphatic group, at least one of $R_1$ and $R_1'$ has a negative charge, and $W_1$ is a counterion if necessary to balance the charge.

In another preferred embodiment the inner dye layer contains at least one dye of Formula Id:

Id

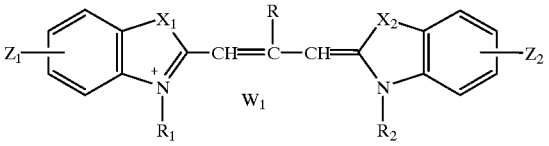

wherein:

$X_1$, $X_2$, independently represent S, Se, O, or N—R', $Z_1$, $Z_2$, each contains independently at least one aromatic group, the dyes can be further substituted, R is hydrogen, substituted or unsubstituted lower alkyl, aryl, alkylaryl, $R_1$ and $R_2$ each independently represents a substituted or unsubstituted aryl or a substituted or unsubstituted aliphatic group, at least one of $R_1$ and $R_2$ has a negative charge, and $W_1$ is a cationic counterion if needed to balance the charge.

The dyes of the second dye layer do not need to be capable of spectrally sensitizing a silver halide emulsion. Some preferred dyes are merocyanine dyes, arylidene dyes, complex merocyanine dyes, hemioxonol dyes, oxonol dyes, triphenylmethane dyes, azo dye types, azomethines or others. It is preferable to have a positively charged dye present in the second layer and more preferably to have both a positively and negatively charged dye present in the second layer Particularly preferred as dyes for the second layer are dyes having structure IIa and IIb, IIIa, and IIIb.

(IIa)

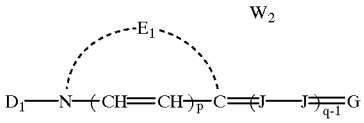

wherein $E_1$, $D_1$, J, p, q and $W_2$ are as defined above for formula (I) and G represents

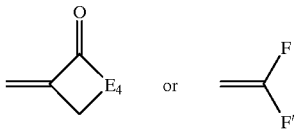

wherein $E_4$ represents the atoms necessary to complete a substituted or unsubstituted heterocyclic acidic nucleus which preferably does not contain a thiocarbonyl, and F and F' each independently represents a cyano radical, an ester radical, an acyl radical, a carbamoyl radical or an alkylsulfonyl radical; and at least one of D1, E1, J, or G has a substituent containing a positive charge, (IIIa)

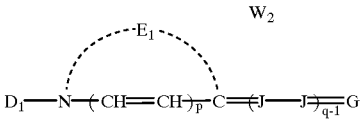

wherein $E_1$, $D_1$, J, p, q G and $W_2$ are as defined above for formula (IIa) and except that at least one of D1, E1, J, or G has a substituent containing a negative charge instead of a positive charge, (IIb)

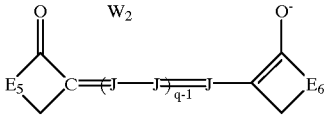

wherein J and $W_2$ are as defined above for formula (I) above and q is 2,3 or 4, and E and $E_6$ independently represent the atoms necessary to complete a substituted or unsubstituted acidic heterocyclic nucleus, and at least one of $E_5$, $E_6$ or J is has a substituent that has a positive charge.

(IIIb)

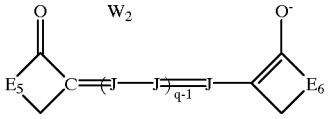

wherein $E_5$, $E_6$, J and $W_2$ are as defined above for formula (IIb) and at least one of $E_5$, $E_6$ or J is has a substituent that has a negative charge instead of a positive charge.

In another preferred embodiment the outer dye layer contains at least one dye of Formula IIc:

IIc

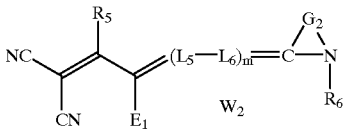

wherein:

$R_5$ represents a substituted or unsubstituted aromatic or heteroaromatic group, a substituted or unsubstituted alkyl or hydrogen, $R_6$ represents a substituted or unsubstituted aryl or substituted or unsubstituted aliphatic group, $G_2$ represent the non-metallic atoms required to complete a substituted or unsubstituted ring system containing at least one 5- or 6-membered heterocyclic nucleus, m may be 0, 1, 2, or 3, $E_1$ represents an electron-withdrawing group; at least one of $R_5$, $L_5$, $L_6$, $G_2$ or $R_6$ has a substituent with a positive charge, and $W_2$ is one or more anionic counterions necessary to balance the charge.

In another preferred embodiment the outer dye layer contains at least one dye of Formula IId:

IId

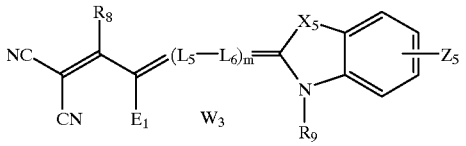

wherein:

$X_5$ independently represent S, Se, O, N—R', or $C(R_aR_b)$, $E_1$ represents an electron-withdrawing group, $R_8$ represents a substituted or unsubstituted aromatic or heteroaromatic group, a substituted or unsubstituted alkyl or hydrogen, $L_5$, $L_6$, $L_7$, $L_8$ independently represents a substituted or unsubstituted methine group, m may be 1, or 2, $Z_6$ is hydrogen or a substituent, at least one of $R_8$, $L_5$, $L_6$, $Z_5$, or $R_9$ has a substituent with a positive charge, and $W_3$ is one or more anionic counterions necessary to balance the charge.

In another preferred embodiment the outer dye layer contains at least one dye of Formula IIe:

IIe

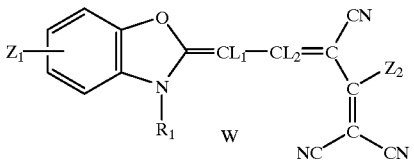

wherein $Z_1$ represents a halogen, substituted or unsubstituted aromatic or heteroaromatic group, a fused aromatic ring, substituted or unsubstituted amide, ester, alkyl or aryl group, $Z_2$ represents a substituted or unsubstituted aromatic or heteroaromatic group, $R_1$ represents a substituted or unsubstituted alkyl group containing a cationic substituent, $L_1$ and $L_2$ represent hydrogen, or substituted or unsubstituted alkyl or aryl, and W is an anionic counterion.

In another preferred embodiment the outer dye layer contains at least one dye of Formula IIf:

IIf

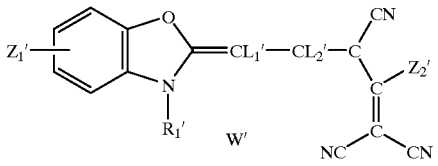

wherein:

$Z_1'$ represents a halogen, a substituted or unsubstituted aromatic or heteroaromatic group, a substituted or unsubstituted aromatic or heteroaromatic group that is linked to the dye by an amide or ester group, or a fused aromatic ring, $Z_2'$ represents a substituted or unsubstituted aromatic or heteroaromatic group, $R_1'$ represents a substituted or unsubstittuted alkyl or aryl group containing an anionic substituent, $L_1'$ and $L_2'$ represents hydrogen, or a substituted or unsubstituted alkyl or aryl, and W is an cationic counterion.

Examples of negatively charged substituents are 3-sulfopropyl, 2-carboxyethyl, 4-sulfobutyl, etc. Examples of positively charged substituents are 3-(trimethylammonio) propyl), 3-(4-ammoniobutyl), 3-(4-guanidinobutyl) etc. Other examples are any substitutents that take on a positive charge in the silver halide emulsion melt, for example, by protonation such as aminoalkyl substitutents, e.g. 3-(3-aminopropyl), 3-(3-dimethylaminopropyl), 4-(4-methylaminopropyl), etc.

When reference in this application is made to a particular moiety as a "group", this means that the moiety may itself be unsubstituted or substituted with one or more substituents (up to the maximum possible number). For example, "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for examples phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

Examples of suitable dye structures are listed below in Table I.

TABLE I

Dye Structures

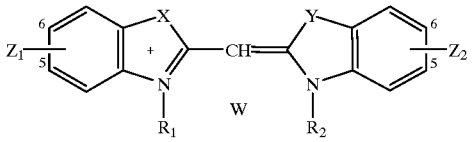

| Dye | $Z_1$ | $Z_2$ | X,Y | $R_1$ | $R_2$ | W | Net Charge |
|---|---|---|---|---|---|---|---|
| I-1 | 5-Ph | 5-Cl | S,S | —$(CH_2)_3SO_3^-$ | —$(CH_2)_3SO_3^-$ | $TEAH^+$ | −1 |
| I-2 | 5-Cl | 5-Cl | S,S | —$(CH_2)_3SO_3^-$ | —$(CH_2)_3SO_3^-$ | $Na^+$ | −1 |
| I-3 | 5-Ph | 5-Ph | S,S | —$(CH_2)_3SO_3^-$ | —$(CH_2)_3SO_3^-$ | $TEAH^+$ | −1 |
| I-4 | 5-Py | 5-Cl | S,S | —$(CH_2)_3SO_3^-$ | —$(CH_2)_3SO_3^-$ | $TEAH^+$ | −1 |
| I-5 | 5-Py | 5-Py | S,S | —$(CH_2)_3SO_3^-$ | —$(CH_2)_3SO_3^-$ | $TEAH^+$ | −1 |
| I-6 | 6-Me | 5-Ph | CH═CH,S | —$(CH_2)_3SO_3^-$ | —$(CH_2)_3SO_3^-$ | $TEAH^+$ | −1 |
| I-7 | 5-Ph | 5-Cl | S,S | —$(CH_2)_3OPO_3^{-2}$ | —$C_2H_5$ | $Na^+$ | −1 |

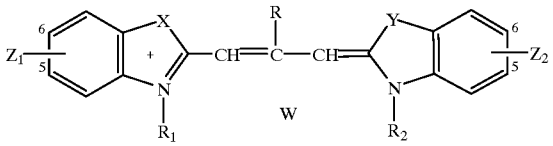

| Dye | X,Y | $R_1$ | $R_2$ | R | $Z_1$ | $Z_2$ | W | Net Charge |
|---|---|---|---|---|---|---|---|---|
| I-8 | O,O | —$(CH_2)_2CH(Me)SO_3^-$ | —$(CH_2)_3SO_3^-$ | Et | 5-Ph | 5-Cl | $TEAH^+$ | −1 |
| I-9 | O,O | —$(CH_2)_2CH(Me)SO_3^-$ | —$(CH_2)_2CH(Me)SO_3^-$ | Et | 5-Ph | 5-Ph | $TEAH^+$ | −1 |
| I-10 | O,O | —$(CH_2)_3SO_3^-$ | —$(CH_2)_3SO_3^-$ | Et | 5-Ph | 5-Ph | $TEAH^+$ | −1 |
| I-11 | O,O | —$(CH_2)_2SO_3^-$ | —$(CH_2)_2SO_3^-$ | Et | 5-Ph | 5-Ph | $TEAH^+$ | −1 |
| I-12 | O,O | —$(CH_2)_3SO_3^-$ | —$(CH_2)_3SO_3^-$ | Et | 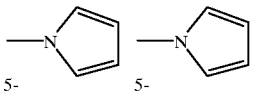 5- | 5- | $Na^+$ | −1 |
| I-13 | O,S | —$(CH_2)_2CH(Me)SO_3^-$ | —$CH_2CH_3$ | Et | 5-Ph | 5-Ph | — | 0 |
| I-14 | O,S | —$CH_2CH_3$ | —$CH_2CONSO_2Me^-$ | Et | 5-Ph | 5-H | — | 0 |
| I-15 | O,S | —$(CH_2)_3SO_3^-$ | —$(CH_2)_3SO_3^-$ | Et | 5-Ph | 5-Cl | $TEAH^+$ | −1 |
| I-16 | S,S | —$(CH_2)_3SO_3^-$ | —$(CH_2)_3SO_3^-$ | Et | Cl | Cl | $TEAH^+$ | −1 |
| I-17 | S,S | —$(CH_2)_3SO_3^-$ | —$(CH_2)_3SO_3^-$ | Et | Ph | Ph | $Na^+$ | −1 |
| I-18 | S,S | —$(CH_2)_3OPO_3^{-2}$ | —$C_2H_5$ | Et | Cl | Cl | $Na^+$ | −1 |
| I-19 | S,S | —$(CH_2)_3SO_3^-$ | —$(CH_2)_3SO_3^-$ | Et | 4,5Benzo | 4,5Benzo | $TEAH^+$ | −1 |
| I-20 | O,S | —$(CH_2)_3SO_3^-$ | —$CH_2CONSO_2Me$ | Et | 5-Ph | 5-H | $TEAH^+$ | −1 |

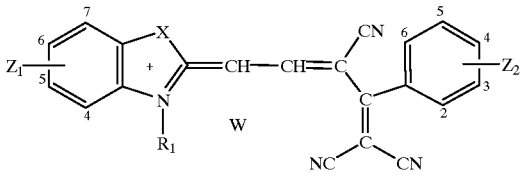

| ye | X | R | $Z_1$ | $Z_2$ | W | Net Charge |
|---|---|---|---|---|---|---|
| I-1 | O | —$(CH_2)_3N(Me)_3^+$ | H | H | $Br^-$ | +1 |
| I-2 | O | —$(CH_2)_3N(Me)_3^+$ | 5-Ph | H | $Br^-$ | +1 |
| I-3 | O | —$(CH_2)_3N(Me)_3^+$ | 5-Ph | 4-Cl | $Br^-$ | +1 |

-continued

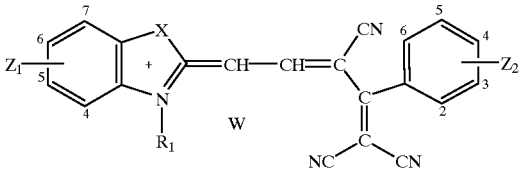

| ye | X | R | $Z_1$ | $Z_2$ | W | Net Charge |
|---|---|---|---|---|---|---|
| I-7 | O | $—(CH_2)_3N(Me)_3^+$ | 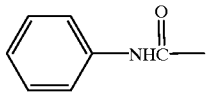 5- | H | $Br^-$ | +1 |
| I-9 | O | $—(CH_2)_3N(Me)_3^+$ | 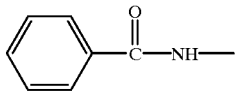 5- | H | $Br^-$ | +1 |
| I-10 | O | 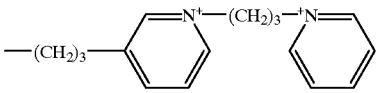 | H | H | $2Br^-$ | +2 |
| I-11 | O | " | 5-Ph | H | $2Br^-$ | +2 |
| I-12 | O | $—(CH_2)_3N(Me)_3^+$ | 5-Cl | H | $PTS^-$ | +1 |
| I-13 | O | $—(CH_2)_3N(Me)_3^+$ | 5-Py | H | $PTS^-$ | +1 |
| I-14 | S | $—(CH_2)_3NH_2$ | 5-Ph | H | — | 0 (+1)* |
| I-15 | S | $—(CH_2)_3N(Me)_3^+$ | 5-Ph | H | Cl— | +1 |
| I-16 | O | $—(CH_2)_3N(Me)_3^+$ | 5,6-Me | H | $PTS^-$ | +1 |
| II-1 | O | $—(CH_2)_3SO_3^-$ | H | H | $Na^+$ | −1 |
| II-2 | O | $—(CH_2)_3SO_3^-$ | 5-Ph | H | $TEAH^+$ | −1 |
| II-3 | O | $—(CH_2)_3SO_3^-$ | 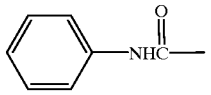 5- | H | $TEAH^+$ | −1 |
| II-4 | O | $—(CH_2)_3SO_3^-$ | 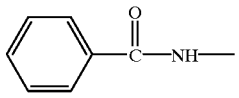 5- | H | $TEAH^+$ | −1 |
| II-5 | O | $—(CH_2)_2SO_3^-$ | 5-Ph | H | $TEAH^+$ | −1 |
| II-6 | O | $—(CH_2)_3SO_3^-$ | 5,6-Me | H | $TEAH^+$ | −1 |
| II-7 | O | $—(CH_2)_3SO_3^-$ | 4,5-Benzo | H | $Na^+$ | −1 |
| II-8 | S | $—(CH_2)_2SO_3^-$ | 5-Ph | H | $TEAH^+$ | −1 |
| II-9 | O | $—(CH_2)_2SO_3^-$ | 5-Py | H | $TEAH^+$ | −1 |
| II-10 | O | $—(CH_2)_2SO_3^-$ | 5-Cl | $CO_2^-$ | $2Na^+$ | −2 |
| II-11 | S | $—(CH_2)_2SO_3^-$ | 5-Cl | $CO_2^-$ | $2Na^+$ | −2 |
| II-12 | O | $—(CH_2)_2CO_2^-$ | 5-Ph | H | $Na^+$ | −1 |

Me is methyl,
Ph is phenyl,
Py is pyrrole-1-yl,
$TEAH^+$ is Triethylammonium,
PTS is p-toluenesulfonate.
*Charge when protonated.

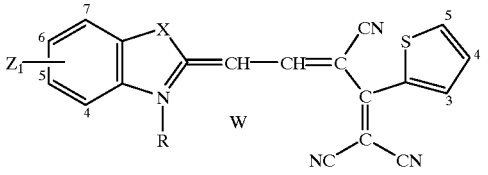

| Dye | R | $Z_1$ | X | W | Net Charge |
|---|---|---|---|---|---|
| II-17 | $—(CH_2)_3N(Me)_3^+$ | 5-Ph | O | $Br^-$ | +1 |
| II-18 | $—(CH_2)_3N(Me)_3^+$ | 5-Ph | S | $PTS^-$ | +1 |
| II-19 | $—(CH_2)_3N(Me)_3^+$ | 5-Cl | O | $Br^-$ | +1 |
| II-20 | $—(CH_2)_3N(Me)_3^+$ | 5,6-M | S | $PTS^-$ | +1 |
| III-13 | $—(CH_2)_3SO_3^-$ | 5-Ph | O | $TEAH^+$ | −1 |
| III-14 | $—(CH_2)_3SO_3^-$ | 5-Ph | S | $TEAH^+$ | −1 |
| III-15 | $—(CH_2)_3SO_3^-$ | 5-Cl | O | $TEAH^+$ | −1 |
| III-16 | $—(CH_2)_3SO_3^-$ | 5,6-Me | S | $Na^+$ | −1 |

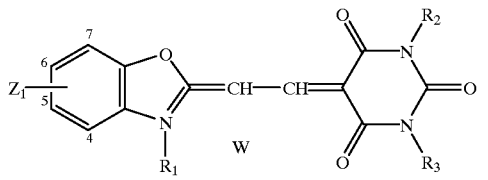

| Dye | $R_1$ | $R_2$ | $R_3$ | $Z_1$ | W | Net Charge |
|---|---|---|---|---|---|---|
| III-17 | $—(CH_2)_3SO_3^-$ | H | H | H | $TEAH^+$ | −1 |
| III-18 | $—(CH_2)_3SO_3^-$ | H | H | 5-Ph | $TEAH^+$ | −1 |
| III-19 | $—(CH_2)_3SO_3^-$ | Ph | H | 5-Ph | $TEAH^+$ | −1 |
| III-20 | —Et | Ph | H | $5\text{-}SO_3^-$ | $Na^+$ | −1 |
| II-21 | $—(CH_2)_3N(Me)_3^+$ | H | H | H | $Br^-$ | +1 |
| II-22 | $—(CH_2)_3N(Me)_3^+$ | H | H | 5-Ph | $Br^-$ | +1 |
| II-23 | $—(CH_2)_3N(Me)_3^+$ | Ph | H | 5-Ph | $Br^-$ | +1 |

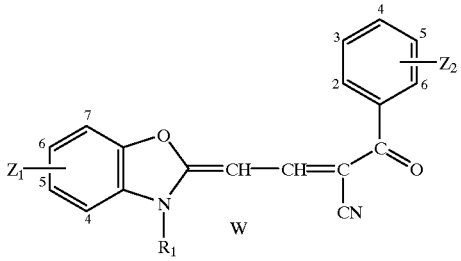

| Dye | $R_1$ | $Z_1$ | $Z_2$ | W | Net Charge |
|---|---|---|---|---|---|
| III-21 | $—(CH_2)_3SO_3^-$ | H | H | $TEAH^+$ | −1 |
| III-22 | $—(CH_2)_3SO_3^-$ | 5-Ph | H | $TEAH^+$ | −1 |
| III-23 | $—(CH_2)_3SO_3^-$ | 5-Ph | 5-Cl | $TEAH^+$ | −1 |
| II-24 | $—(CH_2)_3N(Me)_3^+$ | H | H | $Br^-$ | +1 |
| II-25 | $—(CH_2)_3N(Me)_3^+$ | 5-Ph | H | $Br^-$ | +1 |
| II-26 | $—(CH_2)_3N(Me)_3^+$ | 5-Ph | 4-Cl | $Br^-$ | +1 |

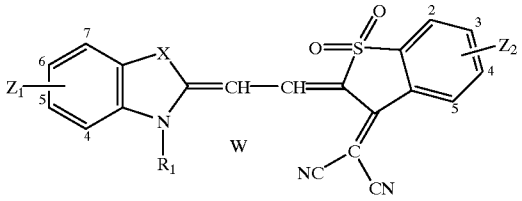

| Dye | $R_1$ | $Z_1$ | $Z_2$ | X | W | Net Charge |
|---|---|---|---|---|---|---|
| III-24 | $—(CH_2)_3SO_3^-$ | 5-Ph | 2-Cl | O | $TEAH^+$ | −1 |
| III-25 | $—(CH_2)_3SO_3^-$ | 5-Py | 2-Cl | O | $TEAH^+$ | −1 |
| III-26 | $—(CH_2)_3SO_3^-$ | H | 2-Cl | O | $TEAH^+$ | −1 |
| III-27 | $—(CH_2)_3SO_3^-$ | 6,7-Benzo | H | $C(Me)_2$ | $Na^+$ | −1 |
| II-27 | $—(CH_2)_3N(Me)_3^+$ | 5-Ph | 2-Cl | O | $Br^-$ | +1 |
| II-28 | $—(CH_2)_3N(Me)_3^+$ | 5-Py | 2-Cl | O | $Br^-$ | +1 |
| II-29 | $—(CH_2)_3N(Me)_3^+$ | H | 2-Cl | O | $Br^-$ | +1 |
| II-30 | $—(CH_2)_3N(Me)_3^+$ | 5-Ph | H | O | Cl | +1 |
| II-31 | $—(CH_2)_3N(Me)_3^+$ | 6,7-Benzo | H | $C(Me)_2$ | $Br^-$ | +1 |

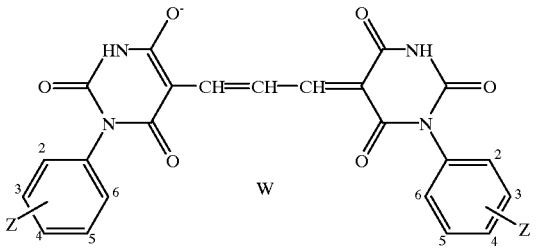
| Dye | Z | W | Net Charge |
|---|---|---|---|
| II-32 | 3-$O(CH_2)_3N(Me)_3^+$ | $Br^-$ | +1 |
| II-33 | 4-$CO_2(CH_2)_3N(Me)_3^+$ | $Br^-$ | +1 |
| III-28 | 3-$CO_2^-$ | $3Na^+$ | −3 |
| III-29 | 4-$CO_2^-$ | $3Na^+$ | −3 |
II-34
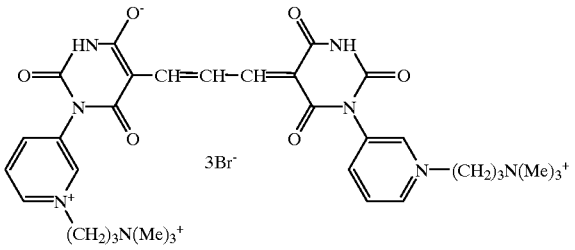
II-35
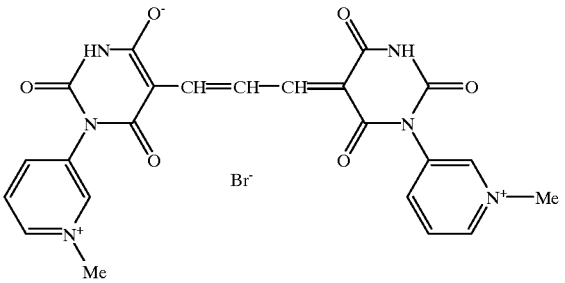
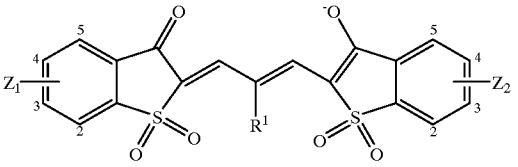
| Dye | $Z_1$ | $Z_2$ | $R_1$ | W | Net Charge |
|---|---|---|---|---|---|
| II-36 | 3-$O(CH_2)_3N(Me)_3^+$ | 3-$O(CH_2)_3N(Me)_3^+$ | H | $Br^-$ | +1 |
| II-37 | 4-$CO_2(CH_2)_3N(Me)_3^+$ | 4-$CO_2(CH_2)_3N(Me)_3^+$ | H | $Br^-$ | +1 |
| III-30 | 3-$CO_2^-$ | 3-$CO_2^-$ | $CH_3$ | $3Na^+$ | −3 |
| III-31 | 4-$CO_2^-$ | 4-$CO_2^-$ | $CH_3$ | $3Na^+$ | −3 |

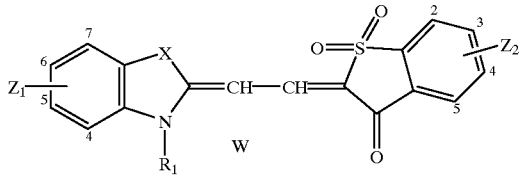

| Dye | $R_1$ | $Z_1$ | $Z_2$ | X | W | Net Charge |
|---|---|---|---|---|---|---|
| III-32 | $—(CH_2)_3SO_3^-$ | 5-Ph | 2-Cl | O | $TEAH^+$ | −1 |
| III-34 | $—(CH_2)_3SO_3^-$ | 5-Py | 2-Cl | O | $TEAH^+$ | −1 |
| III-35 | $—(CH_2)_3SO_3^-$ | 5-Ph | H | O | $TEAH^+$ | −1 |
| II-38 | $—(CH_2)_3N(Me)_3^+$ | 5-Ph | 2-Cl | O | $Br^-$ | +1 |
| II-39 | $—(CH_2)_3N(Me)_3^+$ | 5-Py | 2-Cl | O | $Br^-$ | +1 |
| II-40 | $—(CH_2)_3N(Me)_3^+$ | H | 2-Cl | O | $Br^-$ | +1 |
| II-41 | $—(CH_2)_3N(Me)_3^+$ | 5-Ph | H | O | $Br^-$ | +1 |

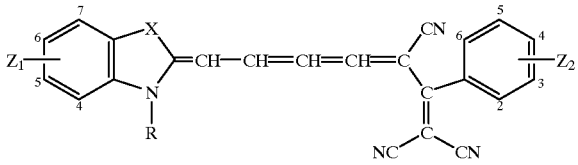

| Dye | X | R | $Z_1$ | $Z_2$ | W | Net Charge |
|---|---|---|---|---|---|---|
| II-42 | O | $—(CH_2)_3N(Me)_3^+$ | H | H | $Br^-$ | +1 |
| II-43 | O | $—(CH_2)_3N(Me)_3^+$ | 5-Ph | H | $Br^-$ | +1 |
| II-44 | O | $—(CH_2)_3N(Me)_3^+$ | 5-Ph | 4-Cl | $Br^-$ | +1 |
| II-45 | O | $—(CH_2)_3N(Me)_3^+$ | 5-Cl | H | $PTS^-$ | +1 |
| III-35 | O | $—(CH_2)_3SO_3^-$ | H | H | $Na^+$ | −1 |
| III-36 | O | $—(CH_2)_3SO_3^-$ | 5-Ph | H | $TEAH^+$ | −1 |

Other non-cyanine dyes that can be used for the outer dye layer in accordance with this invention include, for example:

an oxonol dye of Formula IV:

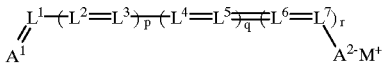

wherein $A^1$ and $A^2$ are ketomethylene or activated methylene moieties, $L^1$–$L^7$ are substituted or unsubstituted methine groups, (including the possibility of any of them being members of a five or six-membered ring where at least one and preferably more than one of p, q, or r is 1); $M^+$ is a cation, and p, q and r are independently 0 or 1;

an oxonol dye of Formulae IV-A or IV-B:

Formula IV-A

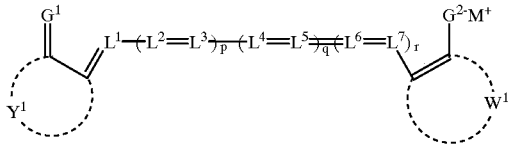

-continued

Formula IV-B

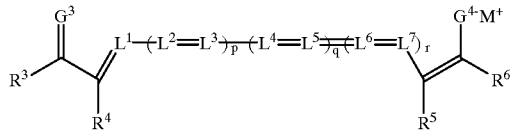

wherein $W^1$ and $Y^1$ are the atoms required to form a cyclic activated methylene/ketomethylene moiety; $R^3$ and $R^5$ are aromatic or heteroaromatic groups; $R^4$ and $R^6$ are electron-withdrawing groups; $G^1$ to $G^4$ is O or dicyanovinyl (—C$(CN)_2$)) and p, q, and r are defined as above, and $L^1$ to $L^7$ are defined as above;

An oxonol dye of Formula V

Formula V

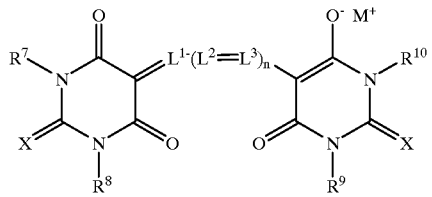

wherein X is oxygen or sulfur; $R^7$–$R^{10}$ each independently represent an unsubstituted or substituted alkyl group, an unsubstituted or substituted aryl group or an unsubstituted or substituted heteroaryl group; $L^1$, $L^2$ and $L^3$ each independently represent substituted or unsubstituted methine groups; M+ represents a proton or an inorganic or organic cation; and n is 0, 1, 2 or 3;

a merocyanine of Formula VI:

VI

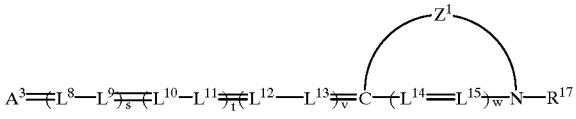

wherein $A^3$ is a ketomethylene or activated methylene moiety as described above; each $L^8$ to $L^{15}$ are substituted or unsubstituted methine groups (including the possibility of any of them being members of a five or six-membered ring where at least one and preferably more than 1 of s, t, v or w is 1); $Z^1$ represents the non-metallic atoms necessary to complete a substituted or unsubstituted ring system containing at least one 5 or 6-membered heterocyclic nucleus; $R^{17}$ represents a substituted or unsubstituted alkyl, aryl, or aralkyl group;

a merocyanine dye of Formula VII-A:

Formula VII-A

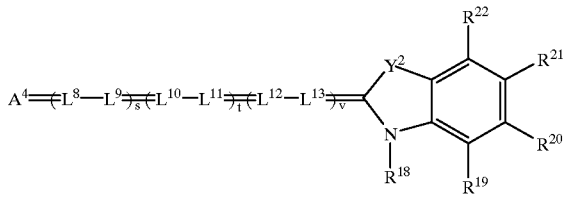

wherein $A^4$ is an activated methylene moeity or a ketomethylene moeity as described above, $R^{18}$ is substituted or unsubstituted aryl, alkyl or aralkyl, $R^{19}$ to $R^{22}$ each individually represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings, or groups containing solubilizing substituents as described above for Y. $L^8$ through $L^{13}$ are methine groups as described above for $L^1$ through $L^7$, $Y^2$ is O, S, Te, Se, $NR_x$, or $CR_yR_z$(where Rx, Ry and Rz are alkyl groups with 1–5 carbons), and s and t and v are independently 0 or 1;

a merocyanine dye of Formula VIII-A:

VIII-A

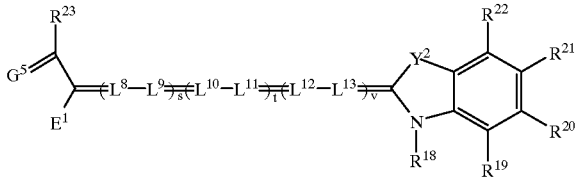

wherein $R^{23}$ is a substituted or unsubstituted aryl, heteroaryl, or a substituted or unsubstituted amino group; $G^5$ is O or dicyanovinyl ($C(CN)_2$), $E^1$ is an electron-withdrawing group, $R^{18}$ to $R^{22}$, $L^8$ to $L^{13}$, $Y^2$, and s, t and v are as described above;

a dye of Formula VIII-B:

VIII-B

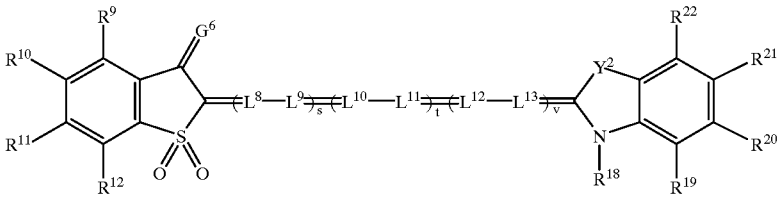

wherein $G^6$ is oxygen (O) or dicyanovinyl ($C(CN)_2$),$R^9$ to $R^{12}$ groups each individually represent groups as described above, and $R^{18}$, $R^{19}$ through $R^{22}$, $Y^2$, $L^8$ through $L^{13}$, and s, t and v are as described above, a dye of Formula VIII-C:

VIII-C

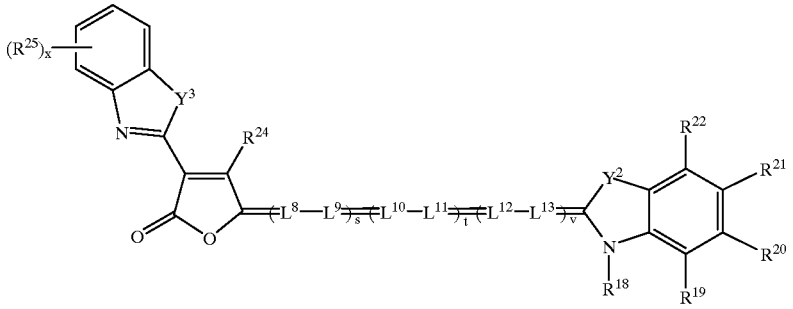

wherein $R^{25}$ groups each individually represent the groups described for $R^{19}$ through $R^{22}$ above, $Y^3$ represents O, S, $NR_x$, or $CR_yR_z$(where Rx, Ry and Rz are alkyl groups with 1–5 carbons), x is 0, 1, 2, 3 or 4, $R^{24}$ represents aryl, alkyl or acyl, and $Y^2$, $R^{18}$, $R^{19}$ through $R^{22}$, $L^8$ through $L^{13}$, and, s, t and v are as described above;

a dye of Formula VIII-D:

VIII-D

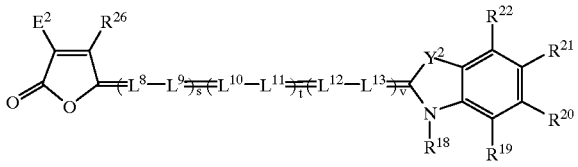

wherein $E^2$ represents an electron-withdrawing group, preferably cyano, $R^{26}$ represents aryl, alkyl or acyl, and $Y^2$, $R^{18}$, $R^{19}$ through $R^{22}$, $L^8$ through $L^{13}$, and, s, t and v are as described above;

a dye of Formula VIII-E:

VIII-E

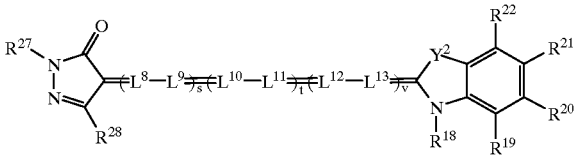

wherein $R^{27}$ is a hydrogen, substituted or unsubstituted alkyl, aryl or aralkyl, $R^{28}$ is substituted or unsubstituted alkyl, aryl or aralkyl, alkoxy, amino, acyl, alkoxycarbonyl, carboxy, carboxylate, cyano, or nitro; $R^{18}$ to $R^{22}$, $L^8$ to $L^{13}$, $Y^2$, and s, t and v are as described above;

a dye of Formula VIII-F:

VIII-F

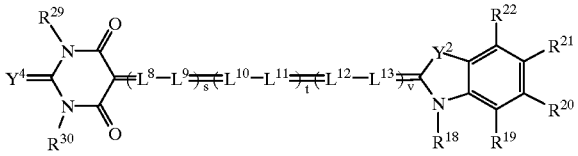

wherein $R^{29}$ and $R^{30}$ are each independently a hydrogen, substituted or unsubstituted alkyl, aryl or aralkyl, $Y^4$ is O or S, $R^{18}$ to $R^{22}$, $L^8$ to $L^{13}$, $Y^2$, and s, t and v are is described above;

a dye of Formula IX:

Formula IX

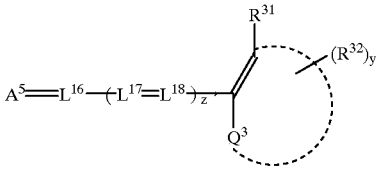

wherein $A^5$ is a ketomethylene or activated methylene, $L^{16}$ through $L^{18}$ are substituted or unsubstituted methine, $R^{31}$ is alkyl, aryl or aralkyl, $Q^3$ represents the non-metallic atoms necessary to complete a substituted or unsubstituted ring system containing at least one 5- or 6-membered heterocyclic nucleus, $R^{32}$ represents groups as described above for $R^{19}$ to $R^{22}$, y is 0, 1, 2, 3 or 4, z is 0, 1 or 2;

a dye of Formula X:

Formula X

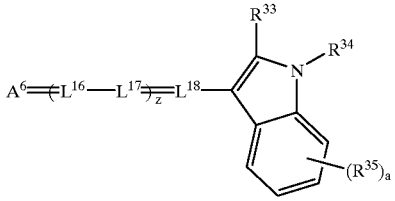

wherein $A^6$ is a ketomethylene or activated methylene, $L^{16}$ through $L^{18}$ are methine groups as described above for L1 through $L^7$, $R^{33}$ is substituted or unsubstituted alkyl, aryl or aralkyl, $R^{34}$ is substituted or unsubstituted aryl, alkyl or aralkyl, $R^{35}$ groups each independently represent groups as described for $R^{19}$ through $R^{22}$, z is 0, 1 or 2, and a is 0, 1,2, 3 or 4;

a dye of Formula XI:

Formula XI

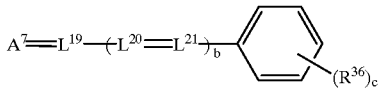

wherein $A^7$ represents a ketomethylene or activated methylene moiety, $L^{19}$ through $L^{21}$ represent methine groups as described above for $L^1$ through $L^7$, $R^{36}$ groups each individually represent the groups as described above for $R^{19}$ through $R^{22}$, b represents 0 or 1, and c represents 0, 1, 2, 3 or 4;

a dye of Formula XII:

Formula XII

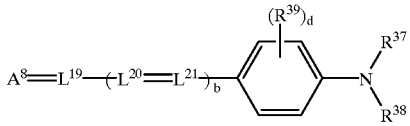

wherein $A^8$ is a ketomethylene or activated methylene, $L^{19}$ through $L^{21}$ and b are as described above, $R^{39}$ groups each individually represent the groups as described above for $R^{19}$ through $R^{22}$, and $R^{37}$ and $R^{38}$ each individually represent the groups as described for $R^{18}$ above, and d represents 0, 1, 2, 3 or 4;

a dye of Formula XIII:

Formula XIII

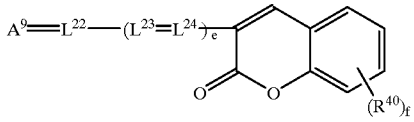

wherein $A^9$ is a ketomethylene or activated methylene moiety, $L^{22}$ through $L^{24}$ are methine groups as described above for $L^1$ through $L^7$, e is 0 or 1, $R^{40}$ groups each individually represent the groups described above for $R^{19}$ through $R^{22}$, and f is 0, 1, 2, 3 or 4;

a dye of Formula XIV:

Formula XIV

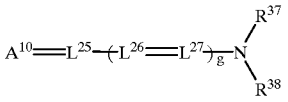

wherein $A^{10}$ is a ketomethylene or activated methylene moiety, $L^{25}$ through $L^{27}$ are methine groups as described above for $L^1$ through $L^7$, g is 0, 1 or 2, and $R^{37}$ and $R^{38}$ each individually represent the groups described above for $R^{18}$; a dye of Formula XV:

Formula XV

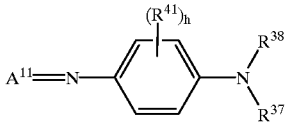

wherein $A^{11}$ is a ketomethylene or activated methylene moiety, $R^{41}$ groups each individually represent the groups described above for $R^{19}$ through $R^{22}$, $R^{37}$ and $R^{38}$ each represent the groups described for R18, and h is 0, 1, 2, 3, or 4;

a dye of Formula XVI:

$$Q^4—N=N—Q^5 \qquad \text{Formula XVI}$$

wherein $Q^4$ and $Q^5$ each represents the atoms necessary to form at least one heterocyclic or carbocyclic, fused or unfused 5 or 6-membered-ring conjugated with the azo linkage;.

Dyes of Formula IV–XVI above are preferably substituted with either a cationic or an anionic group.

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure,* September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); development inhibitors and their precursors (U.S. Pat. Nos. 5,460,932; 5,478,711); electron transfer agents (U.S. Pat. Nos. 4,859,578; 4,912,025); antifoggong and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. Nos. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783, 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed. Tabular grain silver halide emulsions may also be used.

The silver halide grains to be used in the invention may be prepared according to methods known in the art, such as those described in *Research Disclosure I* and *The Theory of the Photographic Process,* $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure,* Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexaco-ordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I.* Also useful as vehicles or vehicle extenders are hydrophilic, water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I,* Section IV (pages 510–511) and the references cited therein.

The silver halide may be sensitized by sensitizing dyes by any method known in the art, such as described in *Research Disclosure I.* The dyes may, for example, be added as a solution or dispersion in water or an alcohol, aqueous gelatin, alcoholic aqueous gelatin, etc. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I,* or in *The Theory of the Photographic Process,* $4^{th}$ edition, T. H. James, editor, Macmillan Publishing Co., New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phetylenediamines. Especially preferred are:

4-amino N,N-diethylaniline hydrochloride,
4-amino-3-methyl-N,N-diethylaniline hydrochloride, 4-amino-3-methyl-N-ethyl-N-(α-(methanesulfonamido) ethylaniline sesquisulfatie hydrate, 4-amino-3-methyl-N-ethyl-N-(α-hydroxyethyl)aniline sulfate, 4-amino-3-α-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure,* Vol. 116, December, 1973, Item 11660, and Bissonette *Research Disclosure,* Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

Example of Dye Synthesis

Quaternary salt intermediates and dyes were prepared by standard methods such as described in Hamer, *Cyanine Dyes and Related Compounds,* 1964 (publisher John Wiley & Sons, New York, N.Y.) and *The Theory of the Photographic Process,* 4$^{th}$ edition, T. H. James, editor, Macmillan Publishing Co., New York, 11977. For example, (3-Bromopropyl)trimethylammonium bromide was obtained from Aldrich. The bromide salt was converted to the hexafluorophosphate salt to improve the compounds solubility in valeronitrile. Reaction of a dye base with 3-(bromopropyl)trimethylammonium hexafluorophosphate in valeronitrile at 135° C. gave the corresponding quaternary salt. For example, reaction of 2-methyl-5-phenylbenzoxazole with 3-(bromopropyl) trimethylammonium hexafluorophosphate gave 2-methyl-5-phenyl-(3-(trimethylammonio)propyl)benzoxazolium bromide hexafluorophosphate. Which could be converted to the bis-bromide salt with tetrabutylammonium bromide. Dyes were prepared from quaternary salt intermediates. For example see the procedures in U.S. Pat. No. 5,213,956.

Example of Phase Behavior and Spectral Absorption Properties of Dyes Dispersed in Aqueous Gelatin Dye dispersions (5.0 gram total weight) were prepared by combining known weights of water, deionized gelatin and solid dye into screw-capped glass vials which were then thoroughly mixed with agitation at 60° C.–80° C. for 1–2 hours in a Lauda model MA 6 digital water bath. Once homogenized, the dispersions were cooled to room temperature. Following thermal equilibration, a small aliquot of the liquid dispersion was transferred to a thin-walled glass capillary cell (0.0066 cm pathlength) using a pasteur pipette. The thin-film dye dispersion was then viewed in polarized light at 16× objective magnification using a Zeiss Universal M microscope fitted with polarizing elements. Dyes forming a liquid-crystalline phase (i.e. a mesophase) in aqueous gelatin were readily identified microscopically from their characteristic birefringent type-textures, interference colors and shear-flow characteristics. (In some instances, polarized-light optical microscopy observations on thicker films of the dye dispersion, contained inside stoppered 1 mm pathlength glass cells, facilitated the identification of the dye liquid-crystalline phase). For example, dyes forming a lyotropic nematic mesophase typically display characteristic fluid, viscoelastic, birefringent textures including so-called Schlieren, Tiger-Skin, Reticulated, Homogeneous (Planar), Thread-Like, Droplet and Homeotropic (Pseudoisotropic). Dyes forming a lyotropic hexagonal mesophase typically display viscous, birefringent Herringone, Ribbon or Fan-Like textures. Dyes forming a lyotropic smectic mesophase typically display so-called Grainy-Mosaic, Spherulitic, Frond-Like (Pseudo-Schlieren) and Oily-Streak birefringent textures. Dyes forming an isotropic solution phase (non-liquid-crystalline) appeared black (i.e. non-birefrigent) when viewed microscopically in polarized light. The same thin-film preparations were then used to determine the spectral absorption properties of the aqueous gelatin-dispersed dye using a Hewlett Packard 8453 UV-visible spectrophotometer. Representative data are shown in Table A.

TABLE A

| Dye | Dye Conc. (% w/w) | Gelatin Conc. (% w/w) | Physical State of Dispersed Dye | Dye Aggregate Type |
|---|---|---|---|---|
| II-2 | 0.04 | 3.5 | smectic liquid crystal | J-aggregate |
| II-7 | 0.05 | 3.5 | smectic liquid crystal | J-aggregate |
| III-1 | 0.10 | 3.5 | smectic liquid crystal | J-aggregate |
| III-2 | 0.04 | 3.5 | smectic liquid crystal | J-aggregate |
| I-1 | 0.06 | 3.5 | smectic liquid crystal | J-aggregate |
| I-2 | 0.03 | 3.5 | smectic liquid crystal | J-aggregate |
| I-8 | 0.05 | 3.5 | smectic liquid crystal | J-aggregate |
| I-9 | 0.05 | 3.5 | smectic liquid crystal | J-aggregate |
| I-12 | 0.02 | 3.5 | smectic liquid crystal | J-aggregate |
| I-15 | 0.10 | 3.5 | smectic liquid crystal | J-aggregate |
| I-16 | 0.05 | 3.5 | smectic liquid crystal | J-aggregate |
| II-1 | 0.08 | 3.5 | smectic liquid crystal | J-aggregate |
| II-11 | 0.06 | 3.5 | nematic liquid crystal | J-aggregate |
| III-3 | 0.06 | 3.5 | smectic liquid crystal | J-aggregate |
| III-5 | 0.04 | 3.5 | smectic liquid crystal | J-aggregate |
| III-19 | 0.10 | 3.5 | isotropic solution | H-aggregate |
| III-24 | 0.11 | 3.5 | smectic liquid crystal | J-aggregate |

The data clearly demonstrate that the thermodynamically stable form of most inventive dyes when dispersed in aqueous gelatin as described above (in the absence of silver halide grains) is liquid crystalline. Furthermore, the liquid-crystalline form of these inventive dyes is J-aggregated and exhibits a characteristically sharp, intense and bathochromically shifted J-band spectral absorption peak, generally yielding strong fluorescence. In some instances the inventive dyes possessing low gelatin solubility preferentially formed a H-aggregated dye solution when dispersed in aqueous gelatin, yielding a hysochromically-shifted H-band spectral absorption peak. Ionic dyes exhibiting the aforementioned aggregation properties were found to be particularly useful as antenna dyes for improved spectral sensitization when used in combination with an underlying silver halide-adsorbed dye of opposite charge.

Photographic Evaluation

EXAMPLE 1

Film coating evaluations were carried out in color format on a sulfur-and-gold sensitized 3.7 μm×0.11 μm silver bromide tabular emulsion containing iodide (3.6 mol %). Details of the precipitation of this emulsion can be found in Fenton, et al., U.S. Pat. No. 5,476,760, incorporated herein by reference. Briefly, 3.6% KI was run after precipitation of 70% of the total silver, followed by a silver over-run to complete the precipitation. The emulsion contained 50 molar ppm of tetrapotassium hexacyanoruthenate ($K_4Ru(CN)_6$) added between 66 and 67% of the silver precipitation. The emulsion (0.0143 mole Ag) was heated to 40° C. and sodium thiocyanate (120 mg/Ag mole) was added and after a 20' hold the first sensitizing dye (see Table III for dye and level) was added. After another 20' the second Sensitizing dye (see Table III for dye and level), if present, was added. After an additional 20' a gold salt (bis(1,3,5-trimethyl-1,2,4-triazolium-3-thiolate) gold(I) tetracluoroborate, 2.2 mg/Ag mole), sulfur agent (dicarboxymethyl-triimethyl-2-thiourea, sodium salt, 2.3 mg/Ag mole) and an antifoggant (3-(3-((methylsulfonyl) amino)-3-oxopropyl)-benzothiazolium tetrafluoroborate), 45 mg/Ag mole) were added at 5' intervals, the melt was held for 20' and then heated to 60° C. for 20'. After cooling to 40° C. the third dye (see Table III for dye and level), when present, and then a fourth dye (see Table III for dye and level), when present, was added to the melt. After 30' at 40° C., gelatin (647 g/Ag mole total), distilled water (sufficient to bring the final concentration to 0.11 Ag mmole/g of melt) and tetrazaindine (1.0 g/Ag mole) were added.

Single-layer coatings were made on support. Total gelatin laydown was 4.8 g/m$^2$ (450 mg/ft$^2$). Silver laydown was 0.5 g/m$^2$ (50 mg/ft$^2$). The emulsion was combined with a coupler dispersion containing coupler C-1 just prior to coating. This is a cyan dye forming coupler and would normally be used in an emulsion layer with a red sensitizing dye. To facilitate analysis in a single layer coating, green sensitizing dyes were also being coated with this coupler. It is understood, however, that for traditional photographic applications the green sensitizing dyes of this invention would be used in combination with a magenta dye forming coupler.

C-1

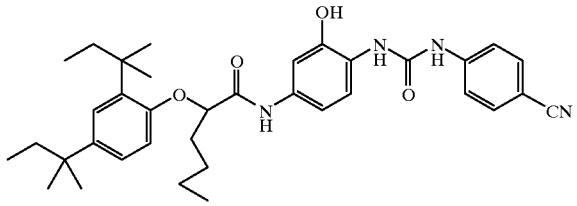

Sensitometric exposures (0.01 sec) were done using 365 nm Hg-line exposure or tungsten exposure with filtration to simulate a daylight exposure and to remove the blue light component. The described elements were processed for 3.25' in the known C-41 color process as described in *Brit. J. Photog. Annual* of 1988, p191–198 with the exception that the composition of the bleach solution was changed to comprise propylenediaminetetraacetic acid. Results are shown in the Table II.

TABLE II

Sensitometric Speed Evaluation of Layered Dyes in Example 1.

| Example | First Dye | First Dye Level[a] | Second Dye | Second Dye Level[a] | Third Dye | Third Dye Level[a] | Fourth Dye | Fourth Dye Level[a] | DL[b] | Normalized Relative Sensitivity[c] | Normalized Relative Absorption | Layering Efficiency | |
|---|---|---|---|---|---|---|---|---|---|---|---|---|---|
| 1-1 | I-8 | 0.76 | I-14 | 0.17 | — | — | — | — | 293 | 100 | 100 | 0 | Comparison |
| 1-2 | I-8 | 0.76 | I-14 | 0.17 | II-2 | 0.76 | III-2 | 0.38 | 307 | 138 | 155 | 69 | Invention |

[a]mmol/Ag mol.
[b]speed from an exposure that simulates a daylight exposure filtered to remove the blue light component. Speed measured at 0.15 above D-min.
[c]normalized relative to the comparison dye.

Photographic Evaluation

EXAMPLE 2

Emulsion sensitization, coating and evaluations were carried out in color format as described in Example 1. Results are described in Table III.

Dye D-1

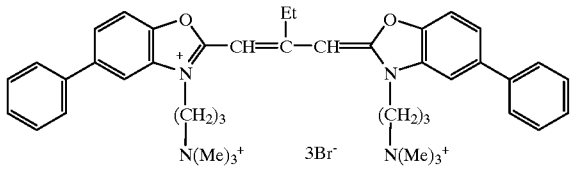

TABLE III

Sensitometric Speed Evaluation of Layered Dyes in Example 2.

| Example | First Dye | First Dye Level[a] | Second Dye | Second Dye Level[a] | Third Dye | Third Dye Level[a] | Fourth Dye | Fourth Dye Level[a] | DL[b] | Normalized Relative Sensitivity[c] | Normalized Relative Absorption | Layering Efficiency | |
|---|---|---|---|---|---|---|---|---|---|---|---|---|---|
| 2-1 | I-8 | 0.76 | I-14 | 0.17 | — | — | — | — | 203 | 100 | 100 | 0 | Comparison |
| 2-2 | I-8 | 0.76 | I-14 | 0.17 | D-1 | 0.76 | I-9 | 0.38 | 309 | 117 | 162 | 27 | Comparison |
| 2-3 | I-8 | 0.76 | I-1 | 0.17 | II-2 | 0.76 | III-2 | 0.38 | 311 | 123 | 145 | 51 | Invention |
| 2-4 | I-8 | 0.76 | I-14 | 0.17 | II-2 | 0.76 | III-2 | 0.76 | 311 | 141 | 158 | 71 | Invention |
| 2-5 | I-8 | 0.76 | I-14 | 0.17 | II-2 | 1.00 | III-2 | 1.00 | 316 | 138 | 174 | 51 | Invention |

[a]mmol/Ag mol.
[b]speed from an exposure that simulates a daylight exposure filtered to remove the blue light component. Speed measured at 0.15 above D-min.
[c]normalized relative to the comparison dye.

Photographic Evaluation

EXAMPLE 3

Emulsion sensitization, coating and evaluations were carried out in color format as described in Example 1. Unexposed coatings were processed (describe process). Absorptance measurements on these processed strips were made to determine the amount of retained sensitizing dye and results are described in Table IV.

TABLE IV

Stain Evaluation of Layered Dyes in Example 3.

| Example | First Dye | First Dye Level[a] | Second Dye | Second Dye Level[a] | Third Dye | Third Dye Level[a] | Fourth Dye | Fourth Dye Level[a] | λmax[b] | Stain Absorptance Units[c] | |
|---|---|---|---|---|---|---|---|---|---|---|---|
| 3-1 | I-8 | 0.76 | I-14 | 0.17 | D-1 | 0.76 | I-9 | 0.38 | 515 | 21.2 | Comparison |
| 3-2 | I-8 | 0.76 | I-14 | 0.17 | II-2 | 0.76 | III-2 | 0.38 | 515 | 13.5 | Invention |

Photographic Evaluation

EXAMPLE 4

Emulsion sensitization, coating and evaluations were carried out in color format as described in Example 1. Results are described in Table V.

TABLE V

Sensitometric Speed Evaluation of Layered Dyes in Example 4.

| Example | First Dye | First Dye Level[a] | Second Dye | Second Dye Level[a] | Third Dye | Third Dye Level[a] | Fourth Dye | Fourth Dye Level[a] | DL[b] | Normalized Relative Sensitivity[c] | Normalized Relative Absorption | Layering Efficiency | |
|---|---|---|---|---|---|---|---|---|---|---|---|---|---|
| 3-1 | I-15 | 0.90 | — | — | — | — | — | — | 284 | 100 | 100 | 0 | Comparison |
| 3-2 | I-15 | 0.90 | — | — | II-2 | 0.76 | III-2 | 0.76 | 306 | 166 | 170 | 94 | Invention |
| 3-3 | I-8 | 0.76 | I-14 | 0.17 | — | — | — | — | 299 | 100 | 100 | 0 | Comparison |
| 3-4 | I-8 | 0.76 | I-14 | 0.17 | II-2 | 0.76 | III-2 | 0.76 | 311 | 132 | 145 | 71 | Invention |
| 3-5 | I-8 | 0.76 | I-14 | 0.17 | II-7 | 0.76 | III-5 | | 311 | 132 | 145 | 71 | Invention |

[a]mmol/Ag mol.
[b]speed from an exposure that simulates a daylight exposure filtered to remove the blue light component. Speed measured at 0.15 above D-min.
[c]normalized relative to the comparison dye.

Photographic Evaluation

EXAMPLE 5

Emulsion sensitization, coating and evaluations were carried out in color format as described in Example 1 except that the emulsion was combined with a coupler dispersion containing coupler C-2 instead of C-1 just prior to coating. Results are described in Table VI.

C-2

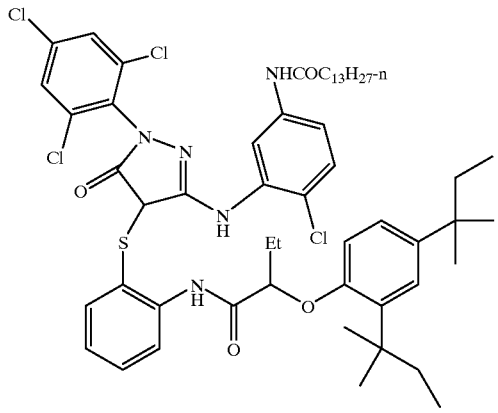

TABLE VI

Sensitometric Speed Evaluation of Layered Dyes in Example 5.

| Example | First Dye | First Dye Level[a] | Second Dye | Second Dye Level[a] | Third Dye | Third Dye Level[a] | Fourth Dye | Fourth Dye Level[a] | DL[b] | Normalized Relative Sensitivity[c] | Normalized Relative Absorption | Layering Efficiency | |
|---|---|---|---|---|---|---|---|---|---|---|---|---|---|
| 4-1 | I-8 | 0.76 | I-14 | 0.17 | — | — | — | — | 319 | 100 | 100 | 0 | Comparison |
| 4-2 | I-8 | 0.76 | I-14 | 0.17 | II-2 | 0.76 | III-2 | 0.76 | 336 | 148 | 158 | 83 | Invention |

[a]mmol/Ag mol.
[b]speed from an exposure that simulates a daylight exposure filtered to remove the blue light component. Speed measured at 0.15 above D-min.
[c]normalized relative to the comparison dye.

Photographic Evaluation

EXAMPLE 6

Emulsion sensitization, coating and evaluations were carried out in color format as described in Example 1. Results are described in Table VII.

TABLE VII

Sensitometric Speed Evaluation of Layered Dyes in Example 6.

| Example | First Dye | First Dye Level[a] | Second Dye | Second Dye Level[a] | Third Dye | Third Dye Level[a] | Fourth Dye | Fourth Dye Level[a] | DL[b] | Normalized Relative Sensitivity[c] | Normalized Relative Absorption | Layering Efficiency | |
|---|---|---|---|---|---|---|---|---|---|---|---|---|---|
| 4-1 | I-8 | 0.76 | I-14 | 0.17 | — | — | — | — | 287 | 100 | 100 | 0 | Comparison |
| 4-2 | I-8 | 0.76 | I-14 | 0.17 | II-2 | 0.50 | III-2 | 0.75 | 303 | 145 | 151 | 88 | Invention |
| 4-3 | " | " | " | " | " | 0.50 | " | 0.50 | 304 | 148 | 141 | 117 | Invention |
| 4-4 | " | " | " | " | " | 0.75 | " | 0.75 | 309 | 166 | 158 | 114 | Invention |
| 4-5 | " | " | " | " | " | 1.00 | " | 0.75 | 310 | 170 | 166 | 94 | Invention |
| | " | " | " | " | " | 0.50 | " | 1.00 | 302 | 141 | 158 | 71 | Invention |
| 4-6 | " | " | " | " | " | 0.75 | " | 0.50 | 306 | 155 | 151 | 108 | Invention |
| 4-7 | " | " | " | " | " | 1.00 | " | 0.50 | 310 | 170 | 170 | 100 | Invention |
| 4-8 | " | " | " | " | " | 1.00 | " | 1.00 | 309 | 166 | 186 | 77 | Invention |
| 4-9 | " | " | " | " | " | 0.75 | " | 1.00 | 309 | 166 | 174 | 89 | Invention |

TABLE VII-continued

Sensitometric Speed Evaluation of Layered Dyes in Example 6.

| Example | First Dye | First Dye Level[a] | Second Dye | Second Dye Level[a] | Third Dye | Third Dye Level[a] | Fourth Dye | Fourth Dye Level[a] | DL[b] | Normalized Relative Sensitivity[c] | Normalized Relative Absorption | Layering Efficiency | |
|---|---|---|---|---|---|---|---|---|---|---|---|---|---|
| 4-10 | I-8 | 0.76 | I-14 | 0.17 | II-2 | 0.75 | — | — | 298 | 129 | 135 | 83 | Invention |
| 4-11 | " | " | " | " | " | 1.00 | — | — | 301 | 138 | 148 | 79 | Invention |

[a]mmol/Ag mol.
[b]speed from an exposure that simulates a daylight exposure filtered to remove the blue light component. Speed measured at 0.15 above D-min.
[c]normalized relative to the comparison dye.

Photographic Evaluation

EXAMPLE 7

A 3.3×0.14 μm silver bromoiodide (overall iodide content 3.8%) tabular grain emulsion was prepared by the following method. To a 4.6 liter aqueous solution containing 0.4 weight percent bone gelatin and 7.3 g/L sodium bromide at 60.5 degrees ° C. with vigorous stirring in the reaction vessel was added by single jet addition of 0.21 M silver nitrate solution at constant flow rate over a 15-minute period, consuming 0.87% of total silver. Subsequently, 351 ml of an aqueous solution containing 25.8 g of ammonium sulfate was added to the vessel, followed by the addition of 158 ml of sodium hydroxide at 2.5 M. After 5 min, 99 mL nitric acid at 4.0 M was added. Then 2.4 liters of an aqueous solution containing 0.74% gelatin by weight and 40 degrees ° C. was added to the reaction vessel and held for 5, minutes. Then an aqueous 3.0M silver nitrate solution and an aqueous solution of 2.97M sodium bromide and 0.03M potassium iodide were added by double jet methods simultaneously to the reaction vessel utilizing accelerated flow rate (23× from start to finish) over 46 minutes while controlling pBr at 0.74, consuming 67.5 mole percent of the total silver. At 44.5 minutes into this segment, a 75 mL of aqueous solution of potassium hexacyanoruthenate at 0.35 percent by weight was added to the reaction vessel. After the accelerated flow segment, both silver and salt solutions were halted and 279 ml of a solution containing 0.973 mg potassium selenocyanate and 10 g of potassium bromide was added. After two minutes the pBr of the vessel was adjusted to 1.21 by addition of sodium bromide salt. Silver iodide Lippmann seed at 3 percent of total silver was then added to the reaction vessel. After a two-minute halt, 3.0M sodium bromide solution was added simultaneously with the silver nitrate solution to the reaction vessel to control pBr at 2.48 until a total of 12.6 moles of silver halide was prepared. The emulsion was cooled to 40 degrees ° C. and washed by ultrafiltration methods.

The emulsion was heated to 43° C. and sodium thiocyanate (100 mg/Ag mole) was added. Then after 5 minutes an antifoggant, [(3-(3-((methylsulfonyl)amino)-3-oxopropyl)-benzothiazolium tetrafluoroborate] (35mg/Ag-mole) was added and after a 5 minute hold the first sensitizing dye (see Table VIII for dye and level) was added. After another 20' the second sensitizing dye (see Table VIII for dye and level) was added. After an additional 20' a gold salt, trisodium dithiosulfato gold (I), was added (2.24 mg/Ag mole) and two minutes later, sodium thiosulfate pentahydrate (1.11 mg/Ag-mole) was also added. The melt was held for 2' and then heated to 65° C. for 5' and then cooled to 40 degrees and tetra-azaindene (0.75 g/Ag-mole) was added. At 40 C. the third dye (see Table VIII for dye and level), and then a fourth dye (see Table VIII for dye and level), was added and then coated as described previously.

TABLE VIII

Sensitometric Speed Evaluation of Layered Dyes in Example 7.

| Example | First Dye | First Dye Level[a] | Second Dye | Second Dye Level[a] | Third Dye | Third Dye Level[a] | Fourth Dye | Fourth Dye Level[a] | DL[b] | Normalized Relative Sensitivity[c] | |
|---|---|---|---|---|---|---|---|---|---|---|---|
| 6-1 | I-8 | 0.67 | I-14 | 0.17 | — | — | — | — | 335 | 100 | Comparison |
| 6-2 | I-8 | 0.67 | I-14 | 0.17 | II-2 | 0.50 | III-2 | 0.50 | 344 | 123 | Invention |
| 6-3 | " | " | " | " | " | 0.50 | " | 0.9 | 342 | 118 | Invention |
| 6-4 | " | " | " | " | " | 0.7 | " | 0.7 | 346 | 129 | Invention |
| 6-5 | " | " | " | " | " | 0.9 | " | 0.5 | 352 | 148 | Invention |
| 6-6 | " | " | " | " | " | 0.9 | " | 0.9 | 349 | 138 | Invention |

[a]mmol/Ag mol.
[b]speed from an exposure that simulates a daylight exposure filtered to remove the blue light component. Speed measured at 0.15 above D-min.
[c]normalized relative to the comparison dye.

Photographic Evaluation

EXAMPLE 8

The silver bromide tabular Emulsion A was prepared according to a formula based on Emulsion H of Deaton et al, U.S. Pat. No. 726,007, incorporated herein by reference, Emulsion A had an ECD of 2.7 micron and thickness of 0.068 micron. Sample 8-1 was prepared in the following manner. A portion of Emulsion A was epitaxialy sensitized in the following manner: 5.3 mL/Ag mole of 3.76 M sodium chloride solution and 0.005 mole/Ag mole of a AgI Lippmann seed emulsion were added at 40° C. Then 0.005 mole/Ag mole each of $AgNO_3$ (0.50 M solution) and NaBr (0.50 M solution) were simultaneously run into the emulsion over a period of approximately 1 min. Next, 1.221 mmol I-8 and 0.271 mmol I-20 were added and held for 20 min. Then 4.46 mL/mole Ag of a 3.764 M NaCl solution, 33.60 mL/mole Ag of a 0.50 M NaBr solution, and 7.44 mL/Ag mole of a solution containing 1.00 g/L of $K_4Ru(CN)_6$ were combined together and added to the emulsion. Next 0.0064 mole/Ag mole of the AgI Lippmann seed emulsion was also added. Then 72 mL/mole Ag of a 0.5 M $AgNO_3$ solution was added over a period of 1 min. The emulsion was further chemically sensitized with sodium thiocyasate (180 mg/mole Ag), 1,3-dicarboxymethyl- 1,3-dimethyl-2-thiourea (10 μmole/mole Ag), and bis (1,3,5-trimethyl-1,2,4-triazolium-3-thiolate) gold(I) tetrafluoroborate (2 μmole/mole Ag). The antifoggant 1-(3-acetamidophenyl)-5-mercaptotetrazole (11.44 mg/Ag mole) was also added. Then the temperature was raised to 50 C. at a rate of 5 C. per 3 min interval and held for 15 min before cooling back to 40 C. at a rate of 6.6 C. per 3 min interval. Finally, an additional 114.4 mg/Ag mole of 1-(3-acetamidophenyl)-5-mercaptotetrazole was added.

Sample 8-2 was prepared in the following manner. A portion of Emulsion A was sensitized in exactly the same manner as Example 8- 1, except that after those steps were completed, 1.5 mmole each of II-2 and III-2 were added and held for 20 min at 40 C.

The sensitized emulsion samples were coated on a cellulose acetate film support with antihalation backing. The coatings contained 8.07 mg/dm2 Ag, 32.30 mg/dm2 gelatin, 16.15 mg/dm2 cyan dye-forming couple C-1, 2 g/Ag mole 4-hydroxy-6-methyl-1,3,3a,7-tetraazaindene, and surfactants. A protective overcoat containing gelatin and hardener was also applied.

The dried coated samples were given sensitometric exposures (0.01 sec) using a 365 nm Hg-line exposure and using a Wratten 9™ filtered 5500 K daylight exposure through a 21 step calibrated neutral density step tablet. The exposed coatings were developed in the color negative Kodak Flexicolor™ C41 process. Speed was measured at a density of 0.15 above minimum density and is reported in relative log units. Contrast was measured as mid-scale contrast (gamma). The sensitometric results are shown in Table IX.

TABLE IX

Sensitometric Speed Evaluation of Layered Dyes in Example 8.

| Example | D-min | Relative 365 nm Speed | Relative Daylight Speed | |
|---|---|---|---|---|
| 8-1 | 0.05 | 100 | 100 | Comparison |
| 8-2 | 0.06 | 95 | 132 | Invention |

It can be seen from Photographic Example 1–8 that the dyes of the invention give true photographic speed advantages.

The invention has been described in detail with particular reference to preferred embodiments, but it will be understood that variations and modifications can be effected within the spirit and scope of the invention.

What is claimed is:

1. A silver halide photographic material comprising at least one silver halide emulsion comprising silver halide grains having associated therewith at least two dye layers comprising:

(a) an inner dye layer adjacent to the silver halide grain and comprising at least one cyanine dye, Dye 1, that has at least one anionic substituent and that is capable of spectrally sensitizing silver halide; and (b) an outer dye layer adjacent to the inner dye layer and comprising at least one dye, Dye 2, which is a merocyanine dye, oxonol, dye, arylidene dye, complex merocyanine dye, styryl dye, hemioxonol dye, anthraquinone dye, triphenylmethane dye, azo dye, azomethine dye, or coumarin dye, and that has at least one cationic substituent; wherein the dye layers are held together by non-covalent forces; the outer dye layer adsorbs light at equal or higher energy than the inner dye layer; and the energy emission wavelength of the outer dye layer overlaps with the energy absorption wavelength of the inner dye layer.

2. A silver halide photographic material according to claim 1, wherein the inner layer comprises Dye 1 and at least one additional dye capable of sensitizing silver halide.

3. A silver halide photographic material according to claim 1, wherein the outer layer comprises Dye 2 and at least one additional merocyanine dye, oxonol, dye, arylidene dye, complex merocyanine dye, hemioxonol dye, triphenylmethane dye, azo dye, or azomethine dye.

4. A silver halide photographic material according to claim 1, wherein the following relationship is met:

$$E=100\ \Delta S/\Delta N_a \geqq 10$$

and $$\Delta N_a \geqq 10$$

wherein

E is the layering efficiency;

ΔS is the difference between the Normalized Relative Sensitivity (S) of an emulsion sensitized with the inner dye layer and the Normalized Relative Absorption of an emulsion sensitized with both the inner dye layer and the outer dye layer; and $\Delta N_a$ is the difference between the Normalized Relative Absorption ($N_a$) of an emulsion sensitized with the inner dye layer and the Normalized Relative Absorption of an emulsion sensitized with both the inner dye layer and the outer dye layer.

5. A silver halide photographic material according to claim 1, wherein Dye 2 is an oxonol or merocyanine dye possessing a solubility of 1 weight percent or less in aqueous gelatin.

6. A silver halide photographic material according to claim 5, wherein said oxonol or merocyanine dye forms a J-aggregate in aqueous gelatin at a concentration of 1 weight percent or less.

7. A silver halide photographic material according to claim 5, wherein said oxonol or merocyanine dye forms a liquid-crystalline phase in aqueous gelatin at a concentration of 1 weight, percent or less.

8. A silver halide photographic material according to claim 1, wherein Dye 2 is a n oxonol or merocyanine dye possessing a solubility of 1 weight percent or less in aqueous gelatin.

9. A silver halide photographic material according to claim 1, wherein Dye 2 is an oxonol or merocyanine dye that forms a J-aggregate in aqueous gelatin at a concentration of 1 weight percent or less.

10. A silver halide photographic material according to claim 1, wherein Dye 2 is an oxonol or merocyanine dye that forms a liquid-crystalline phase in aqueous gelatin at a concentration of 1 weight percent or less.

11. A silver halide photographic material according to claim 1, wherein Dye 1 comprises a cyanine dye having at least one anionic substituent and is present at a concentration of at least 80% of monolayer coverage and Dye 2 comprise a merocyanine or oxonol dye having at least one cationic substituent and is present at a concentration of at least 50% of monolayer coverage.

12. A silver halide photographic material according to claim 1, wherein:

(a) the inner dye layer contains one or more cyanine dyes each having at least one anionic substituent, said dye or dyes being present at a concentration of at least 80% of monolayer coverage; and (b) the outer dye layer comprises:

(i) one or more merocyanine or oxonol dyes having at least one cationic substituent, said dye or dyes being present at a concentration of at least 50% of monolayer coverage; and (ii) one or more merocyanine or oxonol dyes having at least one anionic substituent, said dye or dyes being present at a concentration of at least 50% of monolayer coverage.

13. A silver halide photographic material according to claim 1 which the inner dye layer contains at least one dye of Formula Ic and the outer dye layer contains at least one dye of Formula IIa:

Ic

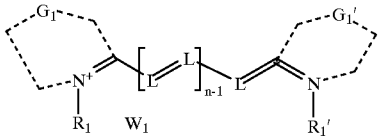

IIa

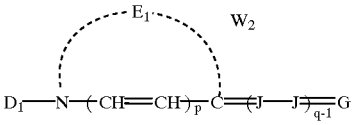

wherein:

$G_1$, $G_1'$ and $E_1$ independently represent the non-metallic atoms required to complete a substituted or unsubstituted ring system containing at least one 5- or 6-membered heterocyclic nucleus;

n is a positive integer from 1 to 4, each L independently represents a substituted or unsubstituted methine group, $R_1$ and $R_1'$ each independently represents substituted or unsubstituted aryl or substituted or unsubstituted aliphatic group, at least one of $R_1$ and $R_1'$ has a negative charge;

$W_1$ is a counterion if necessary to balance the charge, each J independently represents a substituted or unsubstituted methine group, q is a positive integer of from 1 to 4, p represents 0 or 1, $D_1$ represents substituted or unsubstituted aryl or substituted or a unsubstituted aliphatic group, $W_2$ is one or more a counterions as necessary to balance the charge;

G represents

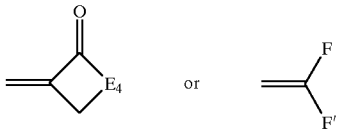

wherein $E_4$ represents the atoms necessary to complete a substituted or unsubstituted heterocyclic acidic nucleus which preferably does not contain a thiocarbonyl, F and F' each independently represents a cyano radical, an ester radical, an acyl radical, a carbamoyl radical or an alkylsulfonyl radical;

at least one of $D_1$, $E_1$, J, or G has a substituent containing a positive charge.

14. A silver halide photographic material according to claim 1 which the inner dye layer contains at least one dye of Formula Ic and the outer dye layer contains at least one dye of Formula IIc:

Ic

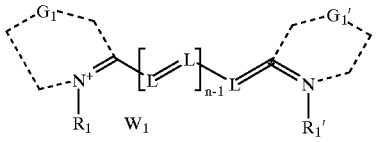

IIc

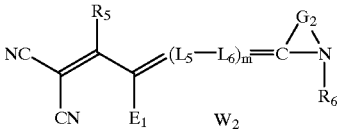

wherein:

$G_1$ and $G_1'$ independently represent the non-metallic atoms required to complete a substituted or unsubstituted ring system containing at least one 5- or 6-membered heterocyclic nucleus;

n is a positive integer from 1 to 4, each L independently represents a substituted or unsubstituted methine group, $R_1$ and $R_1'$ each independently represents substituted or unsubstituted aryl or substituted or unsubstituted aliphatic group, at least one of $R_1$ and $R_1'$ has a negative charge;

$W_1$ is a counterion if necessary to balance the charge, $R_5$ represents a substituted or unsubstituted aromatic or heteroaromatic group, a substituted or unsubstituted alkyl or hydrogen, $R_6$ represents substituted or unsubstituted aryl or substituted or unsubstituted aliphatic group, $G_2$ represent the non-metallic atoms required to complete a substituted or unsubstituted ring system containing at least one 5- or 6-membered heterocyclic nucleus, m may be 0, 1, 2, or 3, $E_1$ represents an electron-withdrawing group at least one of $R_5$, $L_5$, $L_6$, $G_2$ or $R_6$ has a substituent with a positive charge, $W_2$ is one or more anionic counterions necessary to balance the charge.

15. A silver halide photographic material according to claim 1 wherein the inner dye layer contains a dye of Formula Id and the outer dye layer contains a dye of Formula IId:

Id

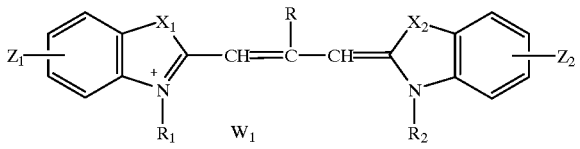

IId

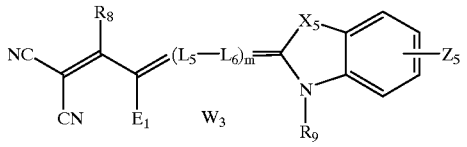

wherein:

$X_1$, $X_2$, independently represent S, Se, O, N—R', $Z_1$, $Z_2$, each contains independently at least one aromatic group, the dyes can be further substituted, R is hydrogen, substituted or unsubstituted lower alkyl, aryl, alkylaryl, $R_1$ and $R_2$ each independently represents substituted or unsubstituted aryl or substituted or unsubstituted aliphatic group, at least one of $R_1$ and $R_2$ has a negative charge, $W_1$ is a cationic counterion if needed to balance the charge, $X_5$ independently represent S, Se, O, N—R', or $C(R_aR_b)$ $E_1$ represents an electron-withdrawing group $R_8$ represents a substituted or unsubstituted aromatic or heteroaromatic group, a substituted or unsubstituted alkyl or hydrogen, $L_5$, $L_6$, $L_7$, $L_8$ independently represents a substituted or unsubstituted methine group, m may be 1, or 2, $Z_6$ is hydrogen or a substituent, at least one of $R_8$, $L_5$, $L_6$, $Z_5$, or $R_9$ has a substituent with a positive charge, $W_3$ is one or more anionic counterions necessary to balance the charge.

16. A silver halide photographic material according to claim 15, wherein the inner dye layer contains a dye of Formula Id in which $X_1$ and $X_2$ represent O and the dye of Formula IId is represented by Formula IIe IIe

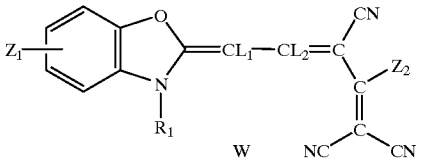

wherein in Formula IIe, $Z_1$ represents a halogen, substituted or unsubstituted aromatic or heteroaromatic group, a fused aromatic ring, substituted or unsubstituted amide, ester, alkyl or aryl group, $Z_2$ represents a substituted or unsubstituted aromatic or heteroaromatic group, $R_1$ represents a substituted or unsubstituted alkyl group containing a cationic substituent, $Z_2$ is a substituted or unsubstituted aromatic or heteroaromatic group, $L_1$ and $L_2$ represent hydrogen, or substituted or unsubstituted alkyl or aryl W is an anionic counterion.

17. A silver halide photographic material according to claim 15, wherein the inner dye layer contains a dye of Formula Id wherein $X_1$ and $X_2$ represent O and wherein the outer dye layer further contains a dye of Formula IIf:

IIf

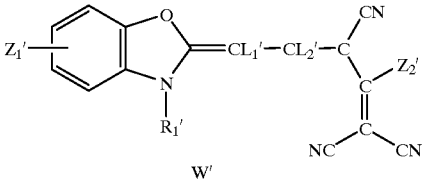

wherein:

$Z_1'$ represents a halogen, substituted or unsubstituted aromatic or heteroaromatic group, substituted or unsubstituted aromatic or heteroaromatic group that is linked to the dye by an amide or ester group, or a fused aromatic ring, $Z_2'$ represents a substituted or unsubstituted aromatic or heteroaromatic group, $R_1'$ represents a substituted or unsubstituted alkyl or aryl group containing an anionic substituent, $L_1'$ and $L_2'$ represents hydrogen, or substituted or unsubstituted alkyl or aryl, W is an cationic counterion.

18. A silver halide photographic material according to claim 1 wherein at least one of the dyes in the outer layer partially decolorizes in processing solutions.

* * * * *